US011998076B2

(12) United States Patent
Lotti

(10) Patent No.: US 11,998,076 B2
(45) Date of Patent: Jun. 4, 2024

(54) APPLICATOR AND METHOD FOR DETACHING ARTIFICIAL HAIRS FROM AN ARTIFICIAL LASH EXTENSION AND AFFIXING THE DETACHED ARTIFICIAL HAIRS AT NATURAL LASHES

(71) Applicant: Lashify, Inc., North Hollywood, CA (US)

(72) Inventor: Sahara Lotti, North Hollywood, CA (US)

(73) Assignee: Lashify, Inc., North Hollywood, CA (US)

( * ) Notice: Subject to any disclaimer, the term of this patent is extended or adjusted under 35 U.S.C. 154(b) by 0 days.

(21) Appl. No.: 17/869,648

(22) Filed: Jul. 20, 2022

(65) Prior Publication Data

US 2023/0038181 A1 Feb. 9, 2023

Related U.S. Application Data

(60) Provisional application No. 63/230,563, filed on Aug. 6, 2021.

(51) Int. Cl.
*A41G 5/02* (2006.01)

(52) U.S. Cl.
CPC ..... *A41G 5/02* (2013.01)

(58) Field of Classification Search
CPC ..... A41G 5/02; A45D 2/48
See application file for complete search history.

(56) References Cited

U.S. PATENT DOCUMENTS

| | | | |
|---|---|---|---|
| 1,831,801 | A | 11/1931 | Birk |
| 1,920,401 | A | 8/1933 | Kahn |
| D101,791 | S | 11/1936 | Rauh |
| D129,526 | S | 9/1941 | Hanisch |
| 2,268,082 | A | 12/1941 | Phillips, Sr. |
| 2,323,595 | A | 7/1943 | Hanisch |
| 2,392,694 | A | 1/1946 | Rector |
| D154,227 | S | 6/1949 | Alvizua |

(Continued)

FOREIGN PATENT DOCUMENTS

| | | |
|---|---|---|
| CN | 102975141 A | 3/2013 |
| CN | 303086463 | 1/2015 |

(Continued)

OTHER PUBLICATIONS

Barbet Machine Translation (Year: 2014).*
International Search Report and Written Opinion dated Oct. 31, 2022, on application No. PCT/US2022/039083.

*Primary Examiner* — Rachel R Steitz
*Assistant Examiner* — Brianne E Kalach
(74) *Attorney, Agent, or Firm* — Lowenstein Sandler LLP

(57) ABSTRACT

An apparatus includes a pair of opposing arms having a first arm and a second arm. The first arm and the second arm are joined at proximal ends. Each of the first arm and the second arm include a first section comprising the proximal end, a second section positioned between and connected to the first section of and a third section, and the third section having a first end portion and a second end portion. The third section having a first curvature disposed between the first end portion and the second end portion. The third section of the first arm includes a plurality of separating elements that extend from an interior surface of the third section.

20 Claims, 16 Drawing Sheets

(56) References Cited

U.S. PATENT DOCUMENTS

D155,559 S 10/1949 Tillmann
2,618,279 A 11/1952 Reiffert
D189,888 S 3/1961 Tapper
3,016,059 A 1/1962 Hutton
3,343,552 A 9/1967 Steffen
D210,180 S 2/1968 Solomon
D213,239 S 1/1969 Flewwellin
3,454,015 A 7/1969 Udes
D215,985 S 11/1969 Silson
3,478,754 A 11/1969 Martin, Jr.
3,516,423 A 6/1970 Seidler
3,547,135 A 12/1970 Roos
3,557,653 A 1/1971 Kim
D219,854 S 2/1971 Howard
3,561,454 A * 2/1971 O'Connell ..... A41G 5/02 D28/36
D222,518 S 10/1971 Brirtain
3,625,229 A 12/1971 Silson
3,645,281 A 2/1972 Seidler
3,670,742 A 6/1972 Weaner
3,703,180 A 11/1972 Aylott
3,828,803 A 8/1974 Windsor
3,833,007 A 9/1974 Jacobs
3,900,038 A * 8/1975 Masters ..... A41G 5/02 132/201
D240,769 S 7/1976 Bowman
4,203,518 A 5/1980 Current
D261,601 S 11/1981 Kettlestrings
4,299,242 A 11/1981 Choe
D269,820 S 7/1983 Bisson
4,395,824 A 8/1983 Puro
D270,551 S 9/1983 Thayer
4,458,701 A * 7/1984 Holland ..... A46B 5/0012 132/218
D281,259 S 11/1985 Hensley
D281,825 S 12/1985 Bakic
4,697,856 A 10/1987 Abraham
D298,070 S 10/1988 Ferrari
D299,561 S 1/1989 Bakic
D301,371 S 5/1989 Kaprelian
D302,602 S 8/1989 Bakic
D314,066 S 1/1991 Bakic
D318,346 S 7/1991 Bakic
5,033,626 A 7/1991 Platti
D328,246 S 7/1992 Nottingham
D342,671 S 12/1993 Elliott
D343,340 S 1/1994 Frye, Jr.
D348,219 S 6/1994 Goldberg
5,322,166 A 6/1994 Crowther
5,377,700 A 1/1995 Harris
D358,312 S 5/1995 Keenan
D358,908 S 5/1995 Rawski
D368,495 S 4/1996 Rypinski
D373,726 S 9/1996 Power
5,571,543 A 11/1996 Song
D379,923 S 6/1997 De Baschmakoff
D380,616 S 7/1997 Leslie
D382,198 S 8/1997 Mulhauser
D386,808 S 11/1997 Litton
D387,483 S 12/1997 Sloan
D388,549 S 12/1997 Mouyiaris
D397,040 S 8/1998 Bakic
D403,922 S 1/1999 Terracciano
D404,531 S 1/1999 Bakic
5,896,996 A 4/1999 Chuang
D411,649 S 6/1999 Bakic
5,944,028 A * 8/1999 Gebhard ..... A45D 2/48 219/222
D418,018 S 12/1999 Winsted
D418,253 S 12/1999 Bakic
6,003,467 A 12/1999 Shelton-Ferrell
6,032,609 A 3/2000 Luoma
6,092,291 A 7/2000 Cendoma
D437,086 S 1/2001 Dickert
6,174,321 B1 1/2001 Webb
6,182,839 B1 2/2001 Robbins
D442,304 S 5/2001 Huang
6,230,715 B1 5/2001 Cho
D443,471 S 6/2001 Lillelund
6,265,010 B1 7/2001 Franco
D448,927 S 10/2001 Vazquez
D452,151 S 12/2001 Scott
D454,981 S 3/2002 Lamagna
D456,077 S 4/2002 Etter
D456,097 S 4/2002 Lamagna
D458,413 S 6/2002 Boilen
6,439,406 B1 8/2002 Duhon
D463,280 S 9/2002 Brozell
D463,744 S 10/2002 Brozell
D464,565 S 10/2002 Weinstein
D464,877 S 10/2002 Weinstein
6,471,515 B2 10/2002 Feuer
D467,800 S 12/2002 Chen
6,530,379 B2 3/2003 Iosilevich
D472,675 S 4/2003 Lamagna
D472,810 S 4/2003 Gelardi
D473,106 S 4/2003 Scherer
6,567,640 B2 5/2003 Ishikawa
D475,616 S 6/2003 Lambrecht
D479,365 S 9/2003 Todeschini
D480,864 S 10/2003 Sayers
D481,946 S 11/2003 Nicholson
D481,952 S 11/2003 Orsomando
D482,495 S 11/2003 Jackel-Marken
D482,928 S 12/2003 Liu
D482,934 S 12/2003 Liu
D483,232 S 12/2003 Liu
D483,633 S 12/2003 Jansson
D483,909 S 12/2003 Todeschini
D485,359 S 1/2004 McMichael
D488,353 S 4/2004 Govrik
D488,618 S 4/2004 Wekstein
D490,932 S 6/2004 Mammone
D495,834 S 9/2004 Todeschini
6,789,551 B2 * 9/2004 Iosilevich ..... A45D 2/48 132/216
D501,580 S 2/2005 Sugawara
D506,573 S 6/2005 de Grandcourt
D507,678 S 7/2005 Lamagna
D509,942 S 9/2005 Connolly
D512,913 S 12/2005 Gauthier
6,981,814 B2 1/2006 Geardino
D515,242 S 2/2006 Cho
D516,247 S 2/2006 Merheje
7,000,775 B2 2/2006 Gelardi
D522,376 S 6/2006 Hales
7,128,213 B2 10/2006 Tung
D532,891 S 11/2006 Buthier
D533,650 S 12/2006 Ohta
7,147,127 B2 12/2006 Lepke
D534,426 S 1/2007 Bakic
7,159,720 B2 1/2007 Pearson
D537,208 S 2/2007 Shaljian
D540,112 S 4/2007 Nichols
D543,662 S 5/2007 Bivona
D543,815 S 6/2007 Metcalf
D543,850 S 6/2007 Legros
D544,148 S 6/2007 Bivona
D544,202 S 6/2007 Markfelder
D545,396 S 6/2007 Casey
7,228,863 B2 6/2007 Dumler
D546,002 S 7/2007 Bowen
D547,940 S 8/2007 Sandy
D561,045 S 2/2008 Lee
D561,942 S 2/2008 Khubani
D563,157 S 3/2008 Bouveret
D563,616 S 3/2008 Lynde
D563,728 S 3/2008 Welch, III
D569,041 S 5/2008 Azoulay
D569,553 S 5/2008 Cho
7,374,048 B2 5/2008 Mazurek
D571,543 S 6/2008 Sungadi
D573,306 S 7/2008 Yoo
D573,308 S 7/2008 Wittke-Kothe

(56) References Cited

U.S. PATENT DOCUMENTS

D575,904 S 8/2008 Iqbal
D579,059 S 10/2008 Chan
D584,449 S 1/2009 Shaljian
D587,529 S 3/2009 Pratt
D588,746 S 3/2009 Ross
D591,599 S 5/2009 Okin
D592,923 S 5/2009 Konopka
D595,054 S 6/2009 Whitaker
7,543,718 B2 6/2009 Simon
D600,441 S 9/2009 Estrada
D602,354 S 10/2009 Dibnah
D604,579 S 11/2009 Robinson
D605,514 S 12/2009 Weber
D607,332 S 1/2010 Huntington
D615,290 S 5/2010 Heffner
D617,187 S 6/2010 Murray
D617,943 S 6/2010 Bouix
D618,078 S 6/2010 Cripps
7,748,391 B2 7/2010 Vance
D627,103 S 11/2010 Cho
D631,606 S 1/2011 Chen
7,896,192 B2 3/2011 Conley
D636,127 S 4/2011 Allison
D638,733 S 5/2011 Sullivan
D639,196 S 6/2011 Sullivan
D640,005 S 6/2011 Lee
D640,834 S 6/2011 Chen
D647,799 S 11/2011 Dunwoody
D650,669 S 12/2011 Dunwoody
D650,670 S 12/2011 Dunwoody
D651,082 S 12/2011 Dunwoody
D657,496 S 4/2012 Flatt
D657,696 S 4/2012 Floyd
D659,330 S 5/2012 Davis
D661,185 S 6/2012 Battat
D661,599 S 6/2012 Floyd
8,196,591 B2 6/2012 Lee
8,205,761 B2 6/2012 Stull, Sr.
D664,011 S 7/2012 Affonso
8,225,800 B2 7/2012 Byrne
D669,223 S 10/2012 Lee
D670,030 S 10/2012 Nguyen
D673,325 S 12/2012 Martines
D679,590 S 4/2013 Stull, Sr.
D679,591 S 4/2013 Stull, Sr.
D679,592 S 4/2013 Stull, Sr.
D679,595 S 4/2013 Stull, Sr.
D679,596 S 4/2013 Stull, Sr.
D682,103 S 5/2013 Jedlicka
D682,688 S 5/2013 Murray
D686,495 S 7/2013 Murray
D690,419 S 9/2013 Porat
8,567,640 B1 10/2013 Johnson-Lofton
8,596,284 B2 12/2013 Byrne
D698,078 S 1/2014 Purizhansky
8,657,170 B2 2/2014 Martinez
D700,799 S 3/2014 Ludeman
8,701,685 B2 4/2014 Chipman
D707,392 S 6/2014 Yu
D707,556 S 6/2014 Kawamura
D709,129 S 7/2014 Moertl
D711,227 S 8/2014 Sheikh
D713,217 S 9/2014 Micara-Sartori
D714,494 S 9/2014 Vasquez
D716,498 S 10/2014 Wolff
D717,038 S 11/2014 Lee
8,881,741 B1 11/2014 Mattson
8,881,744 B2 11/2014 Mckinstry
8,939,159 B2 1/2015 Yeo
9,004,299 B2 4/2015 Hardin
D738,579 S 9/2015 Owens
D738,611 S 9/2015 Gupta
9,215,901 B1 12/2015 Schroeder
D751,904 S 3/2016 Landrum
9,277,777 B2 3/2016 Lee
9,284,111 B2 3/2016 Huang
D753,455 S 4/2016 Hyma
D753,881 S 4/2016 Hussain
9,314,085 B2 4/2016 Hatch
D755,577 S 5/2016 Segal
D757,274 S 5/2016 Gelb
D758,009 S 5/2016 Berkos
9,351,752 B2 5/2016 Slavin
D761,489 S 7/2016 Krakovszki
D762,433 S 8/2016 Yang
D764,688 S 8/2016 Robinson
9,451,800 B2 9/2016 Dinh
9,504,285 B2 11/2016 Lin
D773,915 S 12/2016 Barakat
D775,270 S 12/2016 Moffat
D783,899 S 4/2017 Roh
D783,901 S 4/2017 Kim
D784,615 S 4/2017 Choi
D788,556 S 6/2017 James
D806,315 S 12/2017 Hardwick
D810,534 S 2/2018 Liu
D810,543 S 2/2018 Astradsson
D812,303 S 3/2018 Pascullo
D814,107 S 3/2018 Lotti
D817,132 S 5/2018 Yang
9,993,373 B2 6/2018 Nassif
D823,538 S 7/2018 Ruggaber
D825,333 S 8/2018 Ozamiz
D828,629 S 9/2018 Hussain
D830,170 S 10/2018 Holmes
D832,701 S 11/2018 Oates
D832,702 S 11/2018 Oates
10,149,528 B2 12/2018 Erickson
D836,943 S 1/2019 Klieman
D837,653 S 1/2019 Meranus
10,264,837 B2 4/2019 Park
D847,631 S 5/2019 Villbrandt
D847,632 S 5/2019 Villbrandt
D850,715 S 6/2019 Lotti
10,362,823 B1 7/2019 Hill
D862,796 S 10/2019 Jin Kim
D863,679 S 10/2019 Lotti
D867,664 S 11/2019 Lotti
D867,668 S 11/2019 Lotti
10,479,566 B2 11/2019 Doyle
D871,673 S 12/2019 Qureshi
10,532,861 B2 1/2020 Kimmel
D877,416 S 3/2020 Lotti
D890,430 S 7/2020 Lotti
D895,201 S 9/2020 Lotti
10,892,048 B2 1/2021 Reddy
D914,965 S 3/2021 Lotti
D918,475 S 5/2021 Hu
D926,372 S 7/2021 Liang
D937,482 S 11/2021 Kim
11,219,260 B2 1/2022 Lotti
D952,258 S 5/2022 Lotti
D955,635 S 6/2022 Lotti
D955,645 S 6/2022 Lotti
D961,845 S 8/2022 Wang
2002/0094507 A1 7/2002 Feuer
2003/0005941 A1 1/2003 Iosilevich
2003/0111467 A1 6/2003 Norman
2003/0155317 A1 8/2003 McNeeley
2004/0011372 A1 1/2004 Park
2005/0061341 A1 3/2005 Choe
2005/0166939 A1* 8/2005 Stroud ..... A45D 40/30 132/216
2006/0124658 A1 6/2006 Coe
2006/0129187 A1 6/2006 Cho
2006/0142693 A1 6/2006 Kahen
2007/0050207 A1 3/2007 Merszei
2007/0084749 A1 4/2007 Demelo
2007/0227550 A1 10/2007 Merszei
2007/0272264 A1 11/2007 Byrne
2008/0196732 A1 8/2008 Merszei
2009/0028625 A1 1/2009 Bonneyrat
2009/0217939 A1 9/2009 Rabe
2009/0223534 A1 9/2009 Green

(56) References Cited

U.S. PATENT DOCUMENTS

| | | | | |
|---|---|---|---|---|
| 2009/0266376 | A1 | 10/2009 | Beschta | |
| 2010/0127228 | A1 | 5/2010 | Xie | |
| 2010/0170526 | A1 | 7/2010 | Nguyen | |
| 2011/0079236 | A1 | 4/2011 | Lee | |
| 2011/0121592 | A1 | 5/2011 | Cho | |
| 2011/0127228 | A1 | 6/2011 | Sagel | |
| 2011/0278869 | A1 | 11/2011 | Lee | |
| 2011/0290271 | A1 | 12/2011 | Rabe | |
| 2012/0055499 | A1 | 3/2012 | Sanbonmatsu | |
| 2012/0305020 | A1 | 12/2012 | Byrne | |
| 2013/0110032 | A1 | 5/2013 | Luzon | |
| 2013/0255706 | A1 | 10/2013 | Dinh | |
| 2013/0298931 | A1 | 11/2013 | Samain | |
| 2013/0312782 | A1* | 11/2013 | Kindall | A41G 5/02 132/286 |
| 2013/0320025 | A1 | 12/2013 | Mazzetta | |
| 2013/0333714 | A1 | 12/2013 | Merszei | |
| 2014/0110304 | A1 | 4/2014 | Wu | |
| 2015/0114421 | A1 | 4/2015 | Pham | |
| 2015/0136162 | A1 | 5/2015 | Brouillet | |
| 2015/0173442 | A1 | 6/2015 | Raouf | |
| 2015/0216246 | A1 | 8/2015 | Ahn | |
| 2016/0016702 | A1 | 1/2016 | Siskindovich | |
| 2016/0037848 | A1 | 2/2016 | Lee | |
| 2016/0219959 | A1 | 8/2016 | Chipman | |
| 2016/0324242 | A1 | 11/2016 | Hansen | |
| 2016/0345648 | A1 | 12/2016 | Miniello | |
| 2016/0353821 | A1 | 12/2016 | Calina | |
| 2017/0112214 | A1 | 4/2017 | Ahn | |
| 2017/0112264 | A1 | 4/2017 | Park | |
| 2017/0358245 | A1 | 12/2017 | Dana | |
| 2018/0065779 | A1 | 3/2018 | Chiba | |
| 2018/0098591 | A1 | 4/2018 | Leeflang | |
| 2018/0160755 | A1 | 6/2018 | Hansen | |
| 2018/0242672 | A1 | 8/2018 | Lotti | |
| 2018/0242715 | A1 | 8/2018 | Lotti | |
| 2018/0352886 | A1 | 12/2018 | Schroeder | |
| 2019/0133227 | A1 | 5/2019 | Le | |
| 2019/0191851 | A1 | 6/2019 | Esposito | |
| 2020/0260839 | A1 | 8/2020 | Lotti | |
| 2020/0323325 | A1 | 10/2020 | Kim | |
| 2021/0030140 | A1 | 2/2021 | Chico | |
| 2022/0160094 | A1 | 5/2022 | Lyons | |

FOREIGN PATENT DOCUMENTS

| | | | |
|---|---|---|---|
| CN | 104363790 | A | 2/2015 |
| CN | 305719777 | | 4/2020 |
| CN | 305738664 | | 4/2020 |
| CN | 305916370 | | 7/2020 |
| EP | 1839526 | A1 | 10/2007 |
| EP | 006381257 | | 5/2019 |
| FR | 2897760 | A1 | 8/2007 |
| GB | 1042020 | A | 9/1966 |
| GB | 1307107 | A | 2/1973 |
| GB | 2458230 | * | 9/2009 |
| GB | 6024289 | | 12/2017 |
| JP | 2007222271 | A | 9/2007 |
| JP | 2011177395 | A | 9/2011 |
| JP | 2015105447 | A | 6/2015 |
| JP | 3201846 | U | 1/2016 |
| JP | 2016163699 | A | 9/2016 |
| KR | 200165452 | Y1 | 2/2000 |
| KR | 20020065306 | A | 8/2002 |
| KR | 20090010717 | U | 10/2009 |
| KR | 101336422 | B1 | 12/2013 |
| KR | 300906653 | | 5/2017 |
| RU | 2423058 | C1 | 7/2011 |
| WO | 2008140152 | A1 | 11/2008 |
| WO | 2014029935 | A1 | 2/2014 |
| WO | 2018002914 | A1 | 1/2018 |
| WO | 2018119034 | A1 | 6/2018 |
| WO | 2020082056 | A1 | 4/2020 |

* cited by examiner

APPLICATOR AND METHOD FOR DETACHING ARTIFICIAL HAIRS FROM AN ARTIFICIAL LASH EXTENSION AND AFFIXING THE DETACHED ARTIFICIAL HAIRS AT NATURAL LASHES

RELATED APPLICATION

This application claims the benefit of U.S. Provisional Application No. 63/230,563, filed Aug. 6, 2021, the entire content of which is hereby incorporated in its entirety.

FIELD OF THE INVENTION

Embodiments of the disclosure relate generally to applicators of artificial lash extensions and, more specifically, to applicators for detaching artificial hairs from one or more artificial lash extensions and affixing the detached artificial hairs to a user's natural lashes.

BACKGROUND

False eyelash extensions have conventionally been used to enhance the length, thickness, and fullness of natural eyelashes. Some false eyelashes may be applied directly to an individual's eyelid. False eyelashes can come in strips (and thus may also be referred to as "strip lashes") that can be trimmed to fit the width of the individual's eyelid.

BRIEF DESCRIPTION OF THE DRAWINGS

The disclosure is illustrated by way of example, and not by way of limitation, in the figures of the accompanying drawings in which like references indicate similar elements. It should be noted that different references to "an" or "one" embodiment in this disclosure can be, but are not necessarily to the same embodiment, and such references mean at least one.

Figure 1:
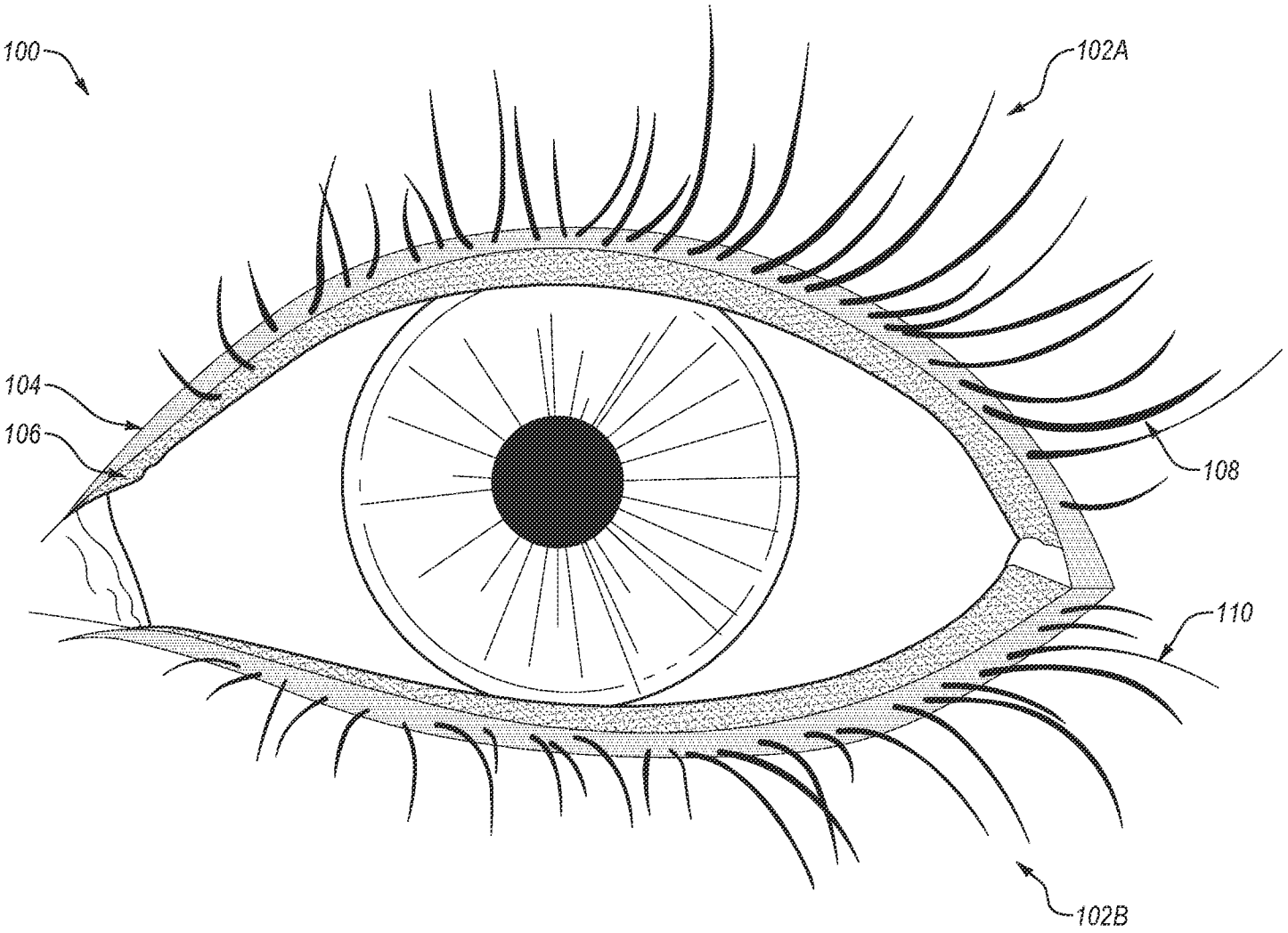
FIG. 1 is an illustration of an eye area, in accordance with some embodiments of the disclosure.

The figures depict various embodiments for the purpose of illustration only. Those skilled in the art will readily recognize that alternative embodiments may be employed without departing from the principles as disclosed herein.

BRIEF SUMMARY

According to some embodiments, disclosed herein is an apparatus comprising: a pair of opposing arms comprising a first arm and a second arm, wherein the first arm and the second arm are joined at proximal ends, each of the first arm and the second arm comprising: a first section comprising the proximal end; a second section positioned between and connected to the first section of and a third section; and the third section comprising a first end portion and a second end portion, the third section having a first curvature disposed between the first end portion and the second end portion, wherein the third section of the first arm comprises a plurality of separating elements that extend from an interior surface of the third section.

In some embodiments, the plurality of separating elements of the third section of the first arm are design to detach artificial hairs from a lash extension of artificial hairs.

In some embodiments, the plurality of separating elements of the third section of the first arm are designed to detach the artificial hairs from the lash extension that is attached to an underside of natural lashes of a user, the detached artificial hairs to remain attached to the underside of the natural lashes of the user.

In some embodiments, the lash extension comprises a plurality of clusters of artificial hairs, and wherein the plurality of separating elements of the third section of the first arm are designed to detach clusters of artificial hairs from the lash extension.

In some embodiments, the interior surface of the third section of the first arm between the plurality of separating elements is designed to press the detached artificial hairs to the natural lashes.

In some embodiments, the third section of the second arm comprises a plurality of slots.

In some embodiments, each of the plurality of slots of the third section of the second arm is configured to receive a respective one of the plurality of separating elements of the third section of the first arm.

In some embodiments, the plurality of separating elements extend substantially perpendicular to the interior surface of the third section.

In some embodiments, the apparatus is configured to transition from an open position to a closed position responsive to an application of pressure to the pair of opposing arms, in the open position the plurality of separating elements and the plurality of slots are configured to be separated from one another, wherein the open position of the apparatus is a default position.

In some embodiments, the closed position comprises a first closed position and a second closed position, in the first closed position at least part of each of the plurality of separating elements are configured to insert within at least a corresponding part of each of the plurality of slots, and in the second closed position the interior surface between the plurality of separating elements of the third section of the first arm is configured to contact the interior surface between the plurality of slots of the third section of the second arm.

In some embodiments, at least a part of the third section is joined with the second section, and wherein the joined part is closer to the second end portion than the first end portion of the third section.

In some embodiments, the first section, the second section, and the third section longitudinally extend toward the proximal end.

In some embodiments, each of the first arm and the second arm comprise: a first side opposite a second side, and an interior surface opposite an exterior surface, wherein the interior surface and the exterior surface extend between the first side and the second side.

In some embodiments, the third section comprises a second curvature disposed between the first end portion and the second end portion and along at least a part of the first side corresponding to the third section, and wherein the second curvature is positioned opposite the first curvature.

In some embodiments, the first curvature is disposed along at least a part of the second side corresponding to the third section, and wherein the first curvature is a concave curvature and the second curvature is a convex curvature.

In some embodiments, an apex of the concave curvature is oriented distally from the second end portion and oriented proximally from the first end portion such that the concave curvature is facing opposite the first side corresponding to the third section.

In some embodiments, the first end portion of the third section comprises a distal end of the respective opposing arm.

In some embodiments, the distal end of the respective opposing arm is a single terminal distal end of the respective opposing arm.

In some embodiments, the first curvature of the third section is designed to align substantially flush with a shape of a lash line.

In some embodiments, the second section comprises a third curvature disposed along at least a part of the second side corresponding to the second section.

In some embodiments, the third curvature is designed to rest above or on a cheek bone or a nose bridge.

In some embodiments, the apparatus comprises at least one of stainless steel, hardened steel, or titanium.

In some embodiments, the first section, the second section, and the third section of the respective opposing arm are formed of a same material.

According to some embodiments, disclosed herein is a method of manufacturing an apparatus for detaching artificial hairs from an artificial lash extension, comprising: forming one or more metal fragments into a pair of opposing arms comprising a first arm and a second arm that are joined at proximal ends, each of the first arm and the second arm comprising: a first section comprising the proximal end; a second section positioned between and connected to the first section of and a third section; and the third section comprising a first end portion and a second end portion, the third section having a first curvature disposed between the first end portion and the second end portion, wherein the third section of the first arm comprises a plurality of separating elements that extend from an interior surface of the third section.

In some embodiments, the method further comprises: applying a non-stick coating to the third sections of the arms.

In some embodiments, the non-stick coating comprises at least one of polytetrafluoroethylene coating or a silicone coating.

In some embodiments, the one or more metal fragments comprises a pair of metal fragments, and wherein forming the pair of metal fragments further comprises: molding at least part of the first arm and the second arm of the pair of opposing arms from a respective metal fragment in the pair of metal fragments; and joining the pair of opposing arms at the proximal end of each opposing arm.

In some embodiments, the one or more metal fragments comprise at least one of stainless steel, hardened steel, or titanium.

In some embodiments, the plurality of separating elements of the third section of the first arm are design to detach artificial hairs from a lash extension of artificial hairs.

In some embodiments, the plurality of separating elements of the third section of the first arm are designed to detach the artificial hairs from the lash extension that is attached to an underside of natural lashes of a user, the detached artificial hairs to remain attached to the underside of the natural lashes of the user.

In some embodiments, the lash extension comprises a plurality of clusters of artificial hairs, and wherein the plurality of separating elements of the third section of the first arm are designed to detach clusters of artificial hairs from the lash extension.

In some embodiments, the interior surface of the third section of the first arm between the plurality of separating elements is designed to press the detached artificial hairs to the natural lashes.

In some embodiments, the third section of the second arm comprises a plurality of slots.

In some embodiments, each of the plurality of slots of the third section of the second arm is configured to receive a respective one of the plurality of separating elements of the third section of the first arm.

In some embodiments, the plurality of separating elements extend substantially perpendicular to the interior surface of the third section.

In some embodiments, the apparatus is configured to transition from an open position to a closed position responsive to an application of pressure to the pair of opposing arms, in the open position the plurality of separating elements and the plurality of slots are configured to be separated from one another, wherein the open position of the apparatus is a default position.

In some embodiments, wherein the closed position comprises a first closed position and a second closed position, in the first closed position at least part of each of the plurality of separating elements are configured to insert within at least a corresponding part of each of the plurality of slots, and in the second closed position the interior surface between the plurality of separating elements of the third section of the first arm is configured to contact the interior surface between the plurality of slots of the third section of the second arm.

In some embodiments, at least a part of the third section is joined with the second section, and wherein the joined part is closer to the second end portion than the first end portion of the third section.

In some embodiments, the first section, the second section, and the third section longitudinally extend toward the proximal end.

In some embodiments, each of the first arm and the second arm comprise: a first side opposite a second side, and an interior surface opposite an exterior surface, wherein the interior surface and the exterior surface extend between the first side and the second side.

In some embodiments, the third section comprises a second curvature disposed between the first end portion and the second end portion and along at least a part of the first side corresponding to the third section, and wherein the second curvature is positioned opposite the first curvature.

In some embodiments, the first curvature is disposed along at least a part of the second side corresponding to the third section, and wherein the first curvature is a concave curvature and the second curvature is a convex curvature.

In some embodiments, an apex of the concave curvature is oriented distally from the second end portion and oriented proximally from the first end portion such that the concave curvature is facing opposite the first side corresponding to the third section.

In some embodiments, the first end portion of the third section comprises a distal end of the respective opposing arm.

In some embodiments, the distal end of the respective opposing arm is a single terminal distal end of the respective opposing arm.

In some embodiments, the first curvature of the third section is designed to align substantially flush with a shape of a lash line.

In some embodiments, the second section comprises a third curvature disposed along at least a part of the second side corresponding to the second section.

In some embodiments, the third curvature is designed to rest above or on a cheek bone or a nose bridge.

In some embodiments, the first section, the second section, and the third section of the respective opposing arm are formed of a same material.

According to some embodiments, disclosed herein is a method comprising: arranging one or more lash extensions of artificial hairs at natural lashes of a user; detaching artificial hairs from the one or more lash extensions that are arranged at the natural lashes using an applicator; and affixing the detached artificial hairs of the one or more lash extensions to the natural lashes using the applicator.

In some embodiments, the applicator comprises a first arm and a second arm of a pair of opposing arms.

In some embodiments, the method further comprises applying pressure to the pair of opposing arms that transitions the applicator from an open position to a closed position, wherein the application of pressure to the pair of opposing arms causes the detaching of the artificial hairs from the one or more lash extensions and the affixing of the detached artificial hairs of the one or more lash extensions to the natural lashes.

In some embodiments, a section of the first arm comprises a plurality of separating elements disposed at an interior surface of the section, and wherein the plurality of separating elements are design to detach the artificial hairs from the one or more lash extension of artificial hairs.

In some embodiments, a corresponding section of the second arm of the applicator comprises a plurality of slots each configured to receive a respective one of the plurality of separating elements of the section of the first arm.

In some embodiments, the one or more lash extension are arranged at an underside of the natural lashes of the user.

In some embodiments, the method further comprises: applying an adhesive to the natural lashes of the user.

In some embodiments, arranging the one or more lash extensions of artificial hairs at the natural lashes of the user comprises arranging the one or more lash extensions adjacent to one another at the natural lashes.

DETAILED DESCRIPTION

As noted above, eyelash extensions have been used to enhance the length, thickness, and fullness of natural eyelashes. Strip lashes applied to a user's eyelids are easily distinguishable from a user's natural lashes and can be unconformable if worn for long periods of time. Some eyelash extensions are applied to an individual's natural lashes hair by hair or in some cases cluster by cluster. Due to the precise nature of applying single hairs or clusters, skilled technicians can perform the application of said single hairs or clusters. Such services can cost hundreds of dollars and take up to several hours to complete.

To address the above and other challenges an applicator is disclosed herein that is designed to detach artificial hairs (e.g., single hairs and/or clusters of artificial hairs) from one or more artificial lash extensions that are attached to the natural lashes (e.g., underside of the natural lashes) of a user. The detached artificial hairs can subsequently be bonded (e.g., affixed) to the natural lashes of the user such that detaching the artificial hairs and bonding the detached artificial hairs can be performed in a single continuous action by the user.

In some embodiments, the applicator can have a pair of opposing arms that are joined together at proximal ends. Each arm includes a first section having the respective proximal end, a second section positioned between and connected to the first section and a third section, and a third section. The third section can have a two end portions between which a curvature is disposed. The third section of one arm includes multiple separating elements (e.g., blades) that extend from the interior surface of the third section. The separating elements can extend substantially perpendicular to the interior surface of the third section of the one arm and can be designed to detach artificial hairs (e.g., clusters of hairs) from one or more artificial lash extensions that are arranged at the underside of the natural lashes, for example. The opposite arm can have a third section having multiple slots that are configured to receive respective ones of the multiple separating elements of the other arm. As the applicator transitions from an open position to a partially closed position, the separating elements of one arm approach the slots of the opposing arm and can detach artificial hairs from the one or more artificial lash extensions.

In some embodiments, the interior surfaces between the separating elements and the slots are substantially flat such that in a fully closed position the interior surfaces between the separating elements contact the respective interior surfaces between the slots. As such, as the applicator transitions from a partially close position to a fully or nearly fully closed position, the applicator can compress the detached artificial hairs, the natural lashes, and any applied adhesive thereabouts to further secure (e.g., bond) the detached artificial hairs to the natural lashes of the user. For example, as pressure is applied to the exterior surface of the opposing arms, the applicator transitions from the open position to the partially closed position and from the partially closed position to the fully closed position such that the applicator can detach the artificial hairs from the one or more artificial lash extensions and bond the detached artificial hairs to the natural lashes based on a single continuous action by the user.

In an illustrative embodiment, an adhesive can be applied to the underside of the natural lashes of the user. One or more natural lash extensions can be arranged at the underside of the natural lashes using the adhesive. Once arranged, the applicator, as described herein, can be used to detach artificial hairs of the one or more artificial lash extensions that are arranged at the underside of the natural lashes and bond the detached artificial hairs to the underside of the natural lashes by applying pressure to the detached artificial hairs, the natural lashes, and applied adhesive.

FIG. 1 is an illustration of an eye area, in accordance with some embodiments of the disclosure. As shown in FIG. 1, the eye area 100, such as a human eye area, can include upper natural lashes 102A (also referred to as "natural lashes 102A," "natural eyelashes 102A," or "natural lash 102A" herein) and lower natural lashes 102B (also referred to as "natural lashes 102B," "natural eyelashes 102B," or "natural lash 102B" herein). Natural lashes 102A and 102B can have an underside and topside opposite the underside. For example, natural lashes 102A illustrate an underside 108. Natural lashes 102B illustrate a topside 110. Natural lashes 102A and 102B are collectively referred to as natural lashes 102, herein.

The eye area 100 includes an upper lash line 104 (also referred to as "lash line 104" herein) and upper waterline 106 (also referred to as "waterline 106" herein). In some embodiments, a lash line, such as the upper lash line 104 or lower lash line of natural lashes 102B, can include the area between the natural lashes. In some embodiments, the lash line can be curved and follow the alignment of the natural lashes 102. In some embodiments, the upper lash line 104 can include some area of the skin that is above (e.g., directly above) the natural lashes 102A and/or below (e.g., directly below) the natural lashes 102A. Similarly, the lower lash line can include some area of the skin that is below (e.g., directly below) the natural lashes 102B and/or above (e.g., directly above) the natural lashes 102B.

In some embodiments, the waterline (also referred to as "wetline" herein), such as upper water line 106 corresponding to natural lashes 102A and lower water line corresponding to natural lashes 102B, can include an area (or line) of skin that is exposed between the natural lashes 102 and the eye.

Spatially relative terms, such as "under," "upper," "lower," "top," "bottom," and so forth as used herein refer to a relative position of one element with respect to another element. Unless otherwise specified, the spatially relative terms are not intended to be limiting to the absolute orientation, and are intended to encompass different orientations (e.g., rotated 90 degrees, flipped, etc.) of elements in addition to the orientation depicted in the Figures. For example, if elements in the Figures are rotated 180 degrees, elements described as "upper" elements can then be considered oriented as "lower" elements, without deviating from aspects of the disclosure.

Figure 2:
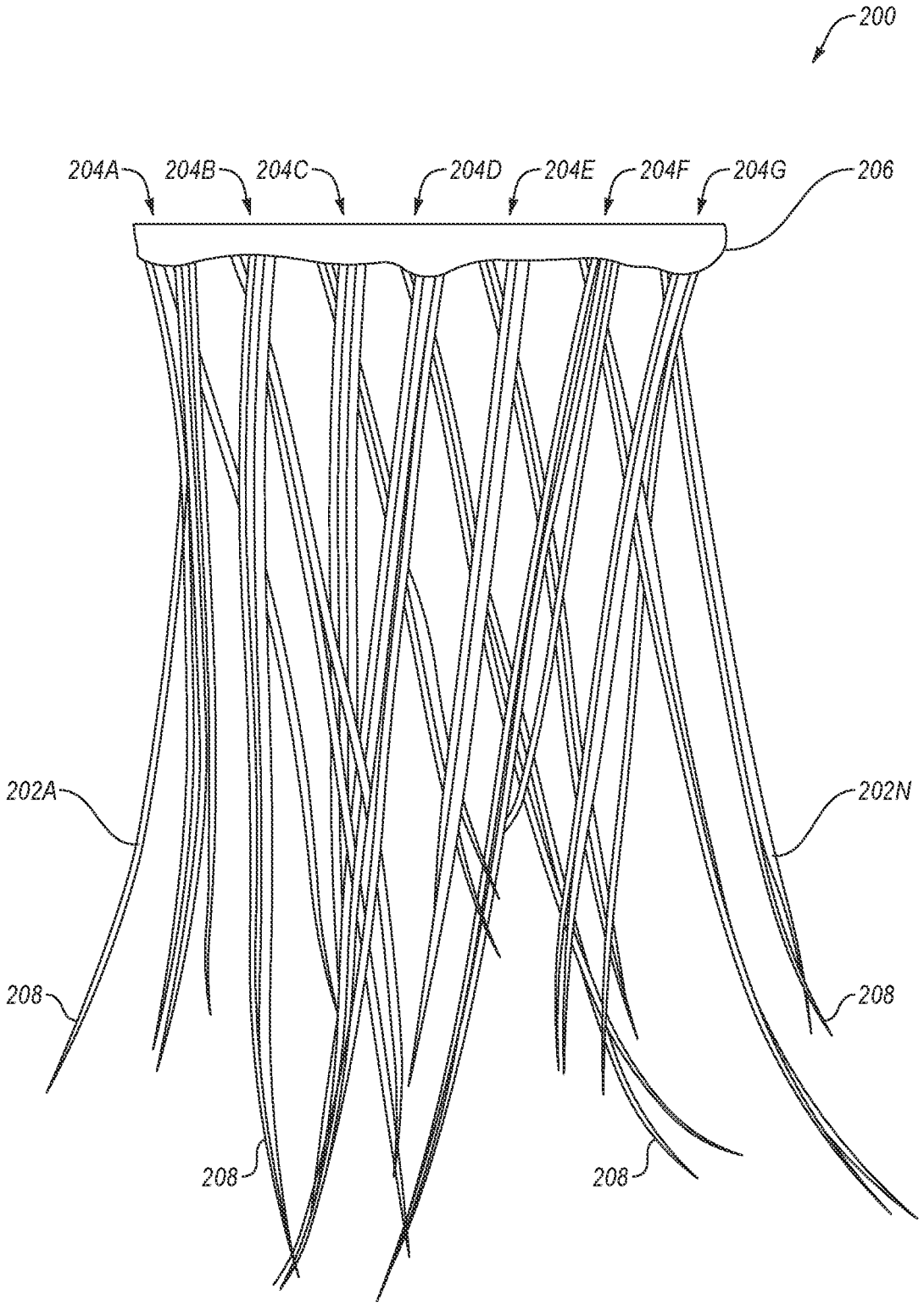
FIG. 2 is an illustration of an exemplary artificial lash extension, in accordance with some embodiments of the disclosure.
Figure 3:
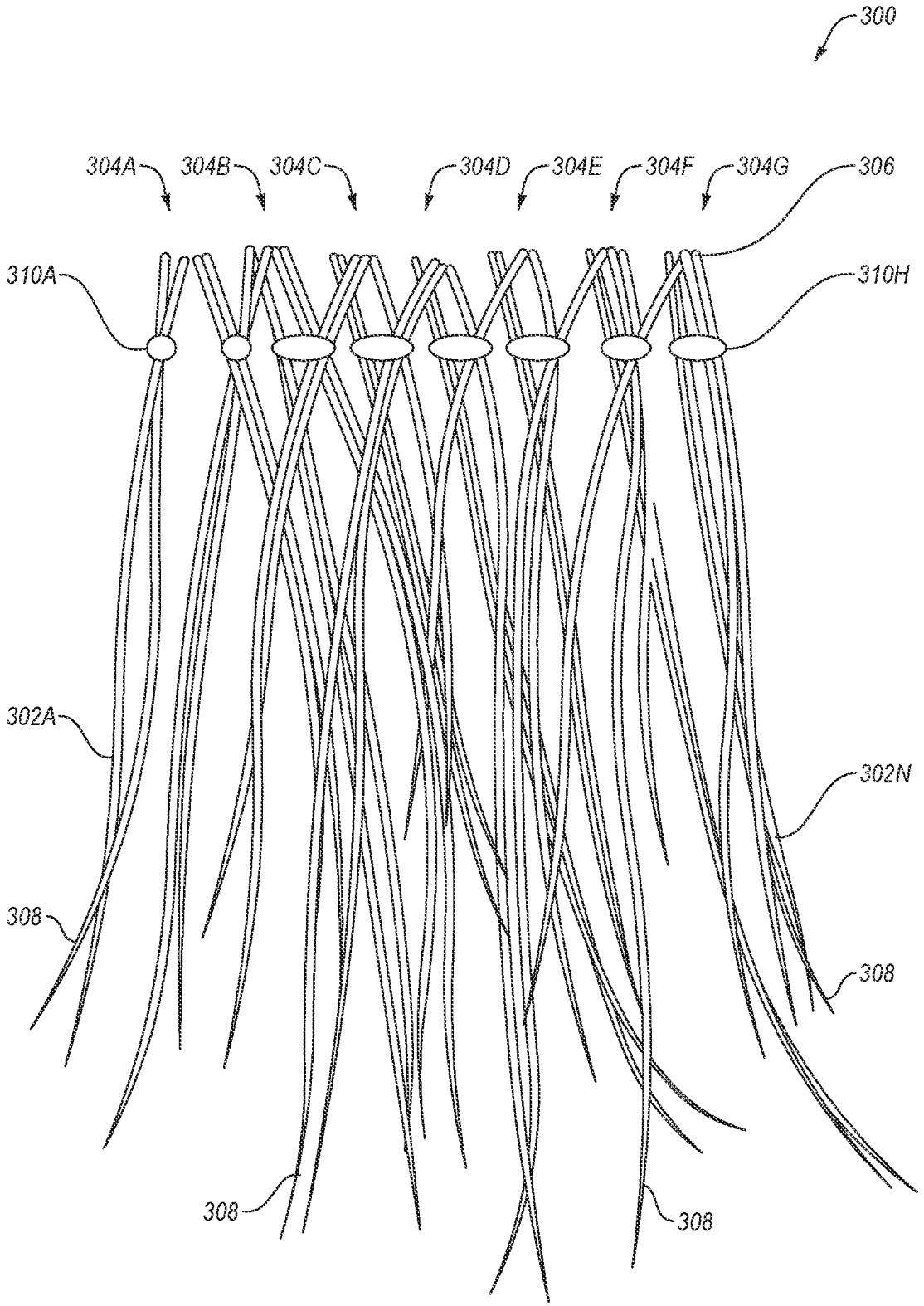
FIG. 3 is an illustration of another exemplary artificial lash extension, in accordance with some embodiments of the disclosure.

FIG. 2 is an illustration of an exemplary artificial lash extension, in accordance with some embodiments of the disclosure. FIG. 3 is an illustration of another exemplary artificial lash extension, in accordance with some embodiments of the disclosure.

In some embodiments, one or more of artificial lash extension 200 or artificial lash extension 300 (both also referred to as "lash extension" or "artificial eyelash extension" herein) are designed or configured for application at the natural lashes, such as at the underside of the natural lashes of a user or even the topside of the natural lashes of a user. In some embodiments, one or more of artificial lash extension 200 or artificial lash extension 300 can be part of a set of multiple artificial lash extensions. In some embodiments, one or more of artificial lash extension 200 or artificial lash extension 300 can be a segment of a "full" artificial lash extension such that, for instance, when multiple artificial lash extensions are arranged adjacent to one another at the underside of natural lashes (e.g., natural lashes 102A) the arranged artificial lash extensions span the length of the natural lashes. In some embodiments, the artificial lash extensions (e.g., segments) can be shorter than the horizontal length of the natural lashes (e.g., length of the lash line). In other embodiments, an artificial lash extension can be longer such that the artificial lash extension is a "full" artificial lash extension that substantially spans the horizontal length of the natural lashes. The artificial lash extensions can be arranged to substantially align with the lash line of the user. In some embodiments, using artificial lash extensions that are independent segments can allow an individual artificial lash extension to move independently when bonded to the underside of natural lashes, which mimics the movement of the natural lashes and can improve the feel, comfort, and longevity of the artificial lash extensions.

Artificial lash extension 200 and artificial lash extension 300 respectively depict artificial hairs 202A-202N (collectively referred to as "artificial hairs 202" herein) and artificial hairs 302A-302N (collectively referred to as "artificial hairs 302" herein). In some embodiments, the artificial hairs of an artificial lash extension, such as artificial lash extension 200 or artificial lash extension 300, can be formed from one or more synthetic materials, including but not limited to polybutylene terephthalate (PBT), acrylic resin, polyester (e.g., polyethylene terephthalate (PET)), other polymers, other synthetic material, or a combination thereof. In alternative embodiments, a natural material such as natural hair (e.g., human hair or mink hair) can be used. In some embodiments, the artificial hairs of a particular artificial lash extension can have one or more lengths and/or one or more diameters. In some embodiments, the diameter of an artificial hair can be between approximately 0.0075 millimeters (mm) (e.g., 0.0075 mm+/−0.0025 mm) to 0.3 mm (e.g., 0.3 mm+/−0.05 mm). In some embodiments, the ends of one or more of the artificial hairs can be tapered. In some embodiments, the one or more of the artificial hairs can be curled or shaped in particular direction. For example, the ends 208 of artificial hairs 202 or the ends 308 of artificial hairs 302 can be tapered or curled or both. In some embodiments, the artificial hairs can range from 3 mm to 30 mm in length or in some instances even longer.

In some embodiments, an artificial lash extension can include a base. For example, artificial lash extension 200 includes base 206. In some embodiments, artificial lash extension 300 may or may not (as illustrated) include a base similar to base 206 of artificial lash extension 200. The base can include a top side (e.g., facing out of the page and towards the reader), a bottom side, a back side, a front side, and two lateral sides. In some embodiments, one or more of the multiple artificial hairs of an artificial lash extension protrude out the front side of the base. When arranged at the underside of natural lashes, the backside of the artificial lash extension can point towards the user's eye. The thickness (e.g., between the topside and bottom side of the base) can be between approximately 0.05 millimeters (mm) and approximately 0.15 mm (e.g., 0.05 mm+/−0.01 mm). In some embodiments, the thickness of the base can be less than 0.05 mm. In some embodiments, the low profile of the base is designed to allow the artificial lash extension to be light weight so as to better adhere to the underside of the natural lashes and in some instances to prevent obstruction of a user's view. The low profile of the base can at least in part be attributed to an application of heat in the formation of the base.

In some embodiments, one or more of the top side or bottom side (e.g., surface) of the base is substantially flat (e.g., having a flatness control tolerance value of +/−0.03 mm or +/−0.015 mm). In some embodiments, the flatness of the base of the artificial lash extension 200 is designed to allow improved contact and adhesion to a surface, such as the underside of natural lashes or the opposing surface of another artificial lash extension. The flatness of the base can at least in part be attributed to an application of heat in the formation of the base.

In some embodiments, the base can be formed at least in part by an application of heat at or near the area of the base. The application of heat can cause one or more of the artificial hairs (e.g. all of the artificial hairs or clusters) of an artificial lash extension to be connected to or at the base. In some embodiments, a heated fixture, such as a heated platen, a heated crimp, heating lamp, heating oven, or other device can be used (e.g., pressed against the artificial hairs) to cause the artificial hairs (e.g., artificial hairs of one or more clusters) to at least become soft, tacky or sticky (e.g., at least partially melt). In some embodiments, the at least partially melted artificial hairs (e.g., of one or more clusters) form at least part of the base. In some embodiments, the application of heat at least partially melts the artificial hairs such that the multiple artificial hairs connect to or at the base of the artificial lash extension. In some embodiments, the application of heat at least partially melts the artificial hairs such that at least some of the multiple artificial hairs connect to each other at the base of the artificial lash extension.

In some embodiments, to at least partially melt the artificial hairs (e.g. and/or artificial hairs of a cluster) at the base the artificial hairs can be heated to a temperature between 55-100 degrees Celsius, which can cause the artificial hairs to be connected to or at the base and/or in some cases to each other. In some embodiments, the application of heat is at a temperature above, within or at the glass transition temperature of the material of the artificial hairs. At the glass transition temperature the material of the artificial hairs transitions from brittle to a softer, rubbery, tacky or pliable state. In some embodiments, the application of heat is at a temperature above, within or at the melt temperature of the material of the artificial hairs. For example, the base area (and/or other parts of the artificial lash extension) can be heated above 200 degrees Celsius.

In some embodiments, one or more additional artificial materials, such as one or more artificial hairs or other material(s) can be placed substantially orthogonal to the artificial hairs (e.g., generally aligned horizontal with respect to the lengthwise direction of the artificial hairs). In some embodiments, the additional artificial material can be connected to the artificial hairs. In some embodiments, the additional artificial material can be considered a base or at least an initial base. In some embodiments, the additional artificial material can be considered at least part of the base that is to be formed. In some embodiments, heat can be applied to the area where the base is to be formed (which can include the additional artificial material). In some embodiments, one or more of the artificial hairs and/or the additional artificial material can at least partially melt to at least in part, form the base. In some embodiments, the additional artificial material can include an adhesive (e.g. application of adhesive) that is used alone or with one or more other artificial material(s) (e.g., horizontal artificial hair, nylon, etc.). In some embodiments, the application of heat can be used to help cure the applied adhesive. In some embodiments that use an adhesive, the application of heat may or may not partially melt the artificial hairs.

In some embodiments, the base can at least in part be formed by an application of pressure. In some embodiments, the base can be formed by an application of pressure combined with an application of heat. For example, an application of pressure along with an application heat can be concurrently applied at the base of the artificial lash extension to cause at least some of the artificial hairs (e.g., some of the artificial hairs of a cluster) to at least partially melt and connect together (e.g., secured together) and/or connect to (e.g., secured to) an additional artificial material.

In some embodiments, prior to the application of heat the artificial hairs may be tied (e.g., knotted) to a support or base thread or fiber to align the artificial hairs and prevent the horizontal spreading of the artificial hairs. Heat can be applied as described above (while the artificial hairs are knotted to a support thread) such that the support thread forms part of the base. In other instances, heat can be applied below the horizontal support thread. For instance, the support thread can hold the artificial hairs in place and the application of heat can form a base below the support thread. In other embodiments, the artificial hairs are not aligned with a support thread (e.g., are not knotted on a support thread) before or during the formation of the base using the application of heat.

In other embodiments, the artificial hairs can be arranged using a stencil or other arrangement device before and/or during the formation of the base using the application of heat. In some embodiments, one or more applications of heat can be performed to form the base. In an alternative embodiment, the base can be formed in part or in full using a chemical process.

In some embodiments, one or more of artificial lash extension 200 and artificial lash extension 300 include artificial hairs 202 and 302 that are respectively configured into clusters of artificial hairs 204A-204G (collectively referred to as "clusters 204" herein) and clusters of artificial hairs 304A-304G (collectively referred to as "clusters 304" herein). In some embodiments, a cluster of artificial hairs can refer to two or more artificial hairs that are grouped together. In some embodiments, two or more artificial hairs of a cluster can contact one another before and/or after an application of heat. In some embodiments, 2-30 artificial hairs can be included in a cluster.

In some embodiments, the clusters of artificial hairs can be connected to or at the base with an application of heat in a similar manner as described above. In some embodiments, the application of heat can at least partially melt at least some of the artificial hairs in one or more clusters of the artificial lash extension. In some embodiments, the application of heat can at least partially melt at least some of the artificial hairs of at least one cluster so that at least some of the artificial hairs of the cluster connect to one other. In some embodiments, the application of heat can at least partially melt at least some of the artificial hairs of at least one cluster so that at least some of the artificial hairs of the cluster connect to the base of the artificial lash extension (and/or form, at least in part, the base of the artificial lash extension). In some embodiments, at least some of the artificial hairs of at least one clusters are connected to one another at a respective part of the base by at least the application of heat.

In some embodiments, the clusters are connected to one another at the base by the application of heat. In some embodiments, one or more of the clusters of the artificial lash extension are directly connected to at least one adjacent cluster at the base. In some embodiments, one or more of the clusters of the artificial lash extension are indirectly connected to at least one adjacent cluster of the artificial lash extension at the base.

In some embodiments, at least two artificial hairs of an artificial lash extension crisscross each other. For example, two artificial hairs of a particular cluster can crisscross one another. In some embodiments, one or more individual clusters of artificial hairs can be formed using an application of heat as described above. Thus, the clusters can have a base (e.g., cluster base). The clusters can be arranged and heat can be applied, as described above, to the cluster bases to form at least in part the base (e.g., base 206) of the artificial lash extension.

In some embodiments, artificial lash extensions 200 or 300 may be 4-10 mm wide. In some embodiments, artificial lash extension 200 or 300 may be 5-6 mm wide. In some embodiments, the width of an artificial lash extension is much wider than a single cluster that is typically 1-2 mm wide.

Artificial lash extension 300 further illustrates adjacent artificial hairs (or adjacent clusters 304) that are coupled or secured to one another at connecting portions 310A-310H (collectively referred to as "connecting portions 310" herein) of the crisscrossing artificial hairs 302. For example, at least one hair of particular cluster can be secured (e.g., directly or indirectly) to one or more hairs of an adjacent cluster at a connecting portion. In some embodiments, connecting portions can connect artificial hairs (e.g., clusters) of an artificial lash extension together at areas between the two ends of the artificial hairs such that the artificial hairs of the of the artificial lash extension are connected directly or indirectly to one another to form an artificial lash extension and both ends of the artificial hairs not connected together (e.g., open ended).

In some embodiments, the connecting portions 310 can be considered a base, as described herein. In some embodiments, the connecting portions can be formed by an application of heat in a similar manner as described herein. In some embodiments, the connecting portions can be formed by an application of pressure in a similar manner as described herein. In some embodiments, the connecting portions 310 can be formed using one or more of an application of heat, an application of adhesive, an application of pressure, or a chemical process as described herein. For example, the crisscrossing artificial hairs 302 are connected or secured together approximately 1 mm to approximately 5 mm (+/−0.5 mm) above the ends 306 of the artificial hairs 302 (e.g. the ends 306 that are opposite the ends 308).

In some embodiments, the clusters can be secured to one another above ends 306 using an artificial material to form connecting portions 310. In some embodiments, additional artificial material such as one or more artificial hairs or other material(s) can be placed or connected horizontally with respect to the lengthwise direction of the artificial hairs (e.g., across the area designated by the connecting portions 310). The artificial hairs or clusters of artificial hairs can be connected to the additional artificial material using one or more of an application of heat, an application of adhesive, an application of pressure or a chemical process as described herein. In some embodiments, the application of the additional artificial material that is used to connect the artificial hairs of artificial lash extension 300 can be similar to the application of additional artificial material used to form a base as described herein.

In some embodiments, the base (similar to base 206 of artificial lash extension 200) can be formed and subsequently removed after the formation of the connecting portions 310, such that the artificial lash extension 300 does not include the base. In some embodiments, the secured connecting portions 310 can hold artificial hairs 302 of the artificial lash extension 300 together in the absence of a base. In some embodiments, the connecting portions 310 of the crisscrossing artificial hairs 302 can be formed without forming a base that similar to base 206 of artificial lash extension 200.

In some embodiments, an artificial lash extension, such as artificial lash extension 200 or artificial lash extension 300, can be designed to be separable such that one or more artificial hairs and/or clusters can be detached from the artificial lash extension. In some embodiments, the one or more artificial hairs and/or clusters can be detached from the artificial lash extension using an applicator, as described herein. In some embodiments, the base and/or connecting portions can be brittle such that artificial hairs and/or clusters can be detached from the artificial lash extension by bending the base or connecting portions artificial lash extension less than 45 degrees from resting position (e.g., flat base). For example, the artificial hairs and/or clusters of an artificial lash extension can be designed such that the connection between the artificial hairs and/or clusters can be broken with minimal force.

It should be appreciated that artificial lash extension 200 and 300 are provided for purposes of illustration, rather than limitation. In some embodiments, artificial lash extension 200 and/or artificial lash extension 300 can be used with an applicator, as described herein. In some embodiments, artificial lash extensions different from artificial lash extension 200 and 300 can be used with applicator, as described herein.

Figure 4A:
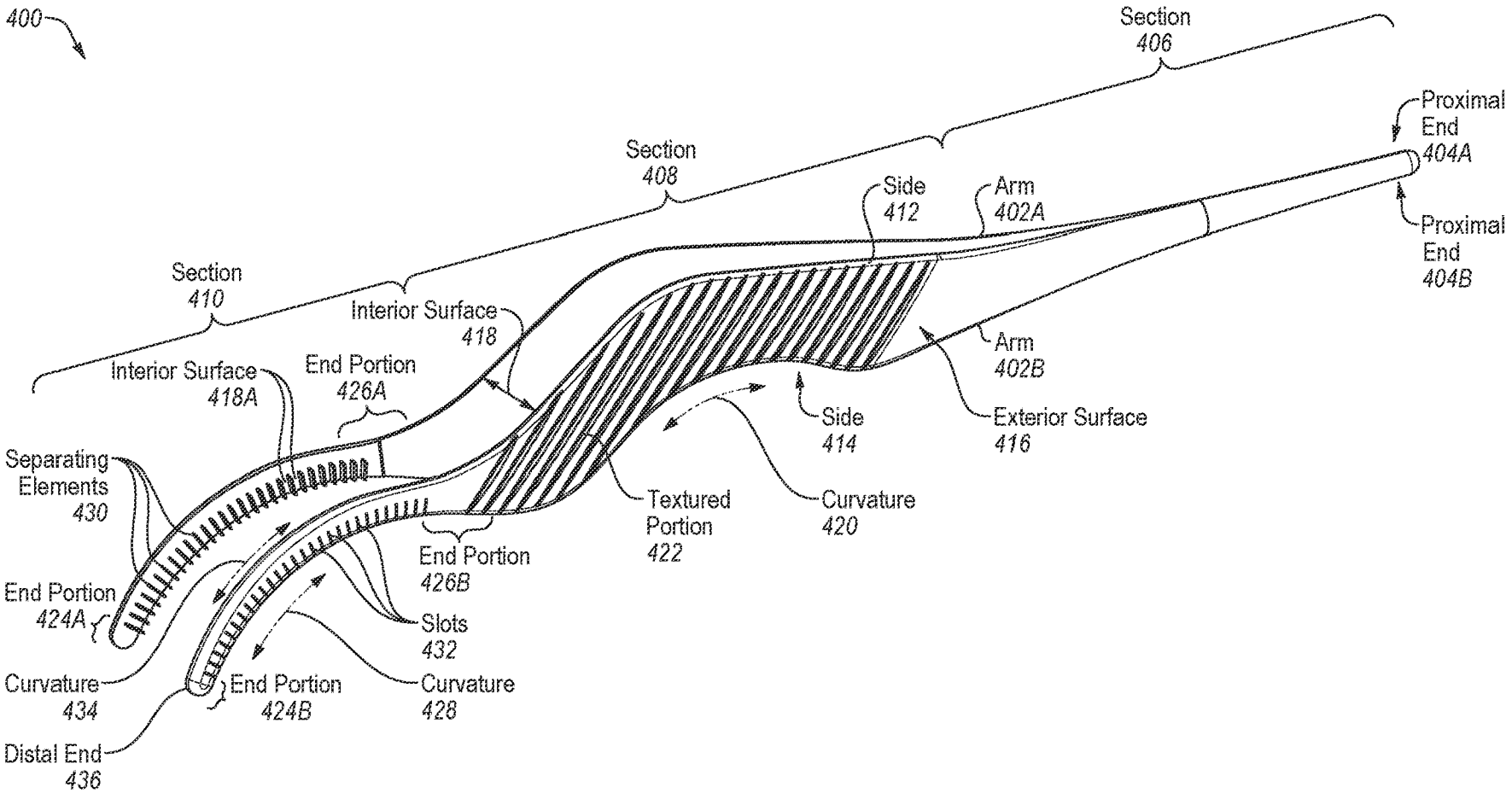
FIG. 4A is an illustration of an applicator, in accordance with some embodiments of the disclosure.

FIG. 4A is an illustration of an applicator, in accordance with some embodiments of the disclosure. Applicator 400 is designed to detach (e.g., separate) artificial hairs (e.g., clusters of artificial hairs) from one or more artificial lash extensions. In some embodiments, applicator 400 is designed to detach artificial hairs from one or more artificial lash extensions that are attached to the natural lashes of the user (e.g., the underside of the natural lashes of the user) such that the detached artificial hairs remain attached to the natural lashes of the user after the artificial hairs are detached from the artificial lash extensions. In some embodiments, the applicator is further designed to improve the bonding between the natural lashes, the detached artificial hairs, and an applied adhesive by compressing or squeezing (e.g., applying pressure) the natural lashes, the detached artificial hairs, and an applied adhesive between some of the interior surfaces of the applicator 400.

In some embodiments, applicator 400 includes a pair of opposing arms such as arm 402A and arm 402B (generally referred to as "arm(s) 402" herein). In some embodiments, arms 402 can be joined together. In some embodiments, arms 402 can be joined together at respective proximal ends, such as proximal end 404A of arm 402A and proximal end 404B of arm 402B (generally referred to as "proximal end(s) 404" herein). In some embodiments, the proximal ends 404 can be joined to form a hinge. For example, the proximal ends 404 can be secured to one another to form a single proximal end of the applicator 400.

In some embodiments, applicator 400 includes side 412 (e.g., top side) and side 414 (e.g., bottom side), an exterior surface 416, and an interior surface 418. In some embodiments, for each arm 402 side 412 is opposite side 414 and the interior surface 418 is opposite exterior surface 416. In some embodiments, the interior surface 418 and the exterior surface 416 of each arm 402 extend between side 412 and side 414.

In some embodiments, each arm 402 can include multiple sections, such as section 406, section 408, and section 410. In some embodiments, section 406 includes a proximal end of a respective arm 402 of the opposing arms of the applicator 400. In some embodiments, section 406 can be tapered along the direction towards the proximal end 404. In other embodiments, section 406 can be any shape or have any type of taper.

In some embodiments, section 408 of each arm 402 can be positioned and connected to the section 406 at one end and to section 410 at the opposite end. In some embodiments, section 408 of each arm 402 can include a curvature 420. In some embodiments, the curvature 420 is a concave curvature. In some embodiments, curvature 420 of each arm is disposed along at least part of side 414 corresponding to section 408. In some embodiment, the curvature 420 is designed to rest above and/or on a cheek bone or nose bride of the user.

In some embodiments, section 408 each arm 402 can include a textured portion 422 on at least part of the exterior surface 416 corresponding to section 408. In some embodiments, the textured portion 422 can be designed to enhance the grip of applicator 400. In some embodiments, the textured portion 422 can include parallel grooves and/or ridges. In other embodiments, the textured portion 422 can include any type of texture. In some embodiments, section 408 does not include a textured portion and is non-textured.

In some embodiments, each arm 402 includes a section 410. In some embodiments, section 410 extends distally from section 408. In some embodiments, section 410 of each arm 402 includes two end portions. For example, section 410 of arm 402A includes end portion 424A and end portion 426A. Section 410 of arm 402B includes end portion 424B and end portion 426B. End portion 424A and end portion 424B are generally referred to as end portion(s) 424 herein. End portion 426A and end portion 426B are generally referred to as end portion(s) 426 herein.

In some embodiments, section 410 of each arm includes a curvature 428 disposed between the end portion 424 and end portion 426. In some embodiments, the curvature 428 of each arm 402 is disposed along the side 414 of the arm 402 corresponding to section 410. In some embodiments, the curvature 428 is a concave curvature. In some embodiments, the apex of curvature 428 and/or curvature 434 of section 410 of each arm 402 is orientated distally from end portion 426 and proximally from end portion 424 such that curvature 428 is facing opposite side 412 of section 410. In some embodiments, curvature 428 of section 410 of each arm 402 is designed to align substantially flush with a shape of a lash line of a user's eye.

In some embodiments, section 410 of each arm 402 includes a curvature 434. In some embodiments, curvature 434 of section 410 of each arm 402 is disposed between end portion 424 and end portion 426. In some embodiments, curvature 434 is disposed along at least part of the side 412 of section 410. In some embodiments, curvature 428 is opposite curvature 434. In some embodiments, curvature 434 includes a convex curvature.

In some embodiments, section 410 of arm 402A includes one or more separating elements 430, such as blades or other structure disposed on an interior surface 418 corresponding to section 410. In some embodiments, the one or more separating elements 430 extend from the interior surface 418 corresponding to section 410 of arm 402A (e.g., interior surface 418A). In some embodiments, the one or more separating elements extend substantially (e.g., ±10 degrees) perpendicular the interior surface 418 of section 410.

In some embodiments, separating elements 430 of section 410 of arm 402A are designed to detach (e.g., separate and/or) artificial hairs from one or more artificial lash extensions. For example, separating elements 430 can be used to separate artificial hairs from the base of an artificial lash extension. In some embodiments, the separating elements of section 410 of arm 402A are designed to detach the artificial hairs from the artificial lash extension that is attached to the natural lashes (e.g., underside) of a user such that detached artificial hairs remain attached to the natural lashes of the user. In some embodiments, the separating elements 430 of the section 410 of arm 402A are designed to detached clusters of artificial hairs from the artificial lash extension. For example, the spacing between the separating elements can be approximately the width of a cluster (e.g., between 0.3-2 mm) such that individual clusters are detached from the artificial lash extension using the separating elements 430.

In some embodiments, the separating elements 430 can include edges that are tapered at the ends (e.g. distal the interior surface 418 of section 410) to form a sharp edge designed to cut or detach artificial hairs from an artificial lash extension. In some embodiments, the separating elements 430 can have relatively dull edges so as not to cut the natural lashes of the user. In some embodiments, the edges of the separating element can be aligned substantially parallel (e.g., ±10 degrees) to the interior surface 418 of section 410 of arm 402A. In some embodiments, the separating elements 430 can be oriented substantially perpendicular to a tangent line of the curvature 428 of section 410 of arm 402A. In other embodiments, the separating elements can have different shapes and/or orientations. For example, the separating elements 430 can be shaped so the edges form a point distal from the interior surface 418 of the section 410. In another example, the separating elements 430 can be shaped at an angle so that a part of the edge of a respective separating element 430 that is closer to curvature 428 of section 410 is positioned further from interior surface 418 of section 410 than another part of the edge of the respective separating element 430 closer to curvature 434 (e.g., incline), or vice versa (e.g., decline). Other shapes and orientations of separating elements 430 are within the scope of the disclosure.

In some embodiments, separating elements 430 can be positioned off-center of interior surface 418 of section 410 of arm 402A. In some embodiments, one side of a respective separating element 430 can be positioned closer to curvature 428 than the opposite side of the respective separating element 430 is positioned to curvature 434 (and vice versa). In some embodiments, the separating elements can be formed in different positions. For example, the separating elements 430 could be positioned in approximately the middle of section 410 between curvature 434 and curvature 428.

In some embodiments, section 410 of the opposite arm 402B can include multiple slots, such as slots 432. In some embodiments, the slots 432 of section 410 of arm 402B are aligned opposite separating elements 430 of section 410 of arm 402A. In some embodiments, the slots 432 of section 410 of arm 402B are configured to receive a respective one of the separating elements 430 of section 410 of the opposite arm 402A. Although separating elements 430 and slots 432 are illustrated on arms 402A and 402B, respectively, in other embodiments, the location of separating elements 430 and slots 432 can be reversed. For example, separating elements 430 can be located at section 410 of arm 402B and slots 432 can be located at section 410 of arm 402A.

In some embodiments, the slots 432 are configured to receive at least part of the respective separating elements 430. In some embodiments, the slots 432 include sidewalls that can surround one or more sides of the respective separating elements 430 when the applicator 400 is in a closed position. In some embodiments, the shape, orientation, and/or position of the slots 432 correspond to the shape, orientation, and/or position of the separating elements 430 and are configured to receive respective separating elements 430 when the applicator 400 is in the closed position. In some embodiments, slots 432 are configured with voids to receive respective separating elements 430. In some embodiments, the slots 432 extend to one of curvature 428 or curvature 434 such that there is a void at side 414 or side 412, respectively. In some embodiments, a slot 432 includes a void that at least extends from the interior surface 418 of section 410 of arm 402B into the body of section 410. In some embodiments and as illustrated, a slot 432 can include a void that extends from the interior surface 418 of section 410 of arm 402B through the body and through the exterior surface 416 of section 410 of arm 402B.

In some embodiments, the interior surface 418A (which can be a portion of the interior surface 418 of arm 402A) of section 410 between separating elements 430 is relatively flat (e.g., having a flatness control tolerance value of +/−0.35 mm or +/−0.015 mm) or relatively planar. In some embodiments, the interior surface 418A of section 410 of arm 402A located between the separating elements 430 is designed to press the detached artificial hairs to the natural lashes. In some embodiments, the interior surface (which is opposite interior surface 418A at the opposing arm 402B) of section 410 between the slots 432 is also relatively flat (e.g., having a flatness control tolerance value of +/−0.35 mm or +/−0.015 mm). In some embodiments, the interior surface 418A between separating elements 430 and interior surface between the slots 432 are designed to contact one another when the applicator 400 is in a closed position. In some embodiments, the interior surface between slots 432 is designed to stabilize the artificial lash extension so that the corresponding separating elements 430 of the opposing arm 402 can separate artificial hairs from the artificial lash extension that is attached to a user's natural lashes. In some embodiments, the interior surfaces between the separating elements 430 and slots 432 are designed to compress or squeeze (apply pressure to) the detached artificial hairs of an artificial lash extension, the natural lashes, and an applied adhesive so that the detached artificial hairs become affixed (e.g. secured) to the natural lashes of the user.

In some embodiments, the separating elements 430 and/or slots 432 can be designed so that the applicator does not cut the hairs of the natural lashes when detaching artificial hairs from an artificial lash extension and/or affixing the detached artificial hairs to the natural lashes of the user.

In some embodiments, the end portion 424 of section 410 of each arm 402 includes a distal end 436 of the respective arm 402 (e.g., the tip of the arm or tips of the applicator 400). In some embodiments, the distal end 436 of each arm 402 is a single terminal distal end of the respective arm 402.

In some embodiments, for each arm 402 at least part of section 410 is joined with section 408. The joined part is closer to end portion 426 than to end portion 424 of section 410. In some embodiments, section 406, section 408, and section 410 longitudinally extend towards the proximal end 404.

In some embodiments, applicator 400 includes or is formed of one or more of stainless steel, hardened steel, or titanium. In some embodiments, section 406, section 408 and section 410 of both arms 402 are formed of the same material.

In some embodiments, applicator 400 can be configured in an open position, as illustrated by applicator 400 of FIG. 4A. In some embodiments, the open position of applicator 400 is the default position. In some embodiments, in the open position the respective sections 410 of each arm do not contact one another. In some embodiments, in the open position the slots 432 and the separating elements 430 are configured to be separated from one another and do not contact one another.

Figure 4B:
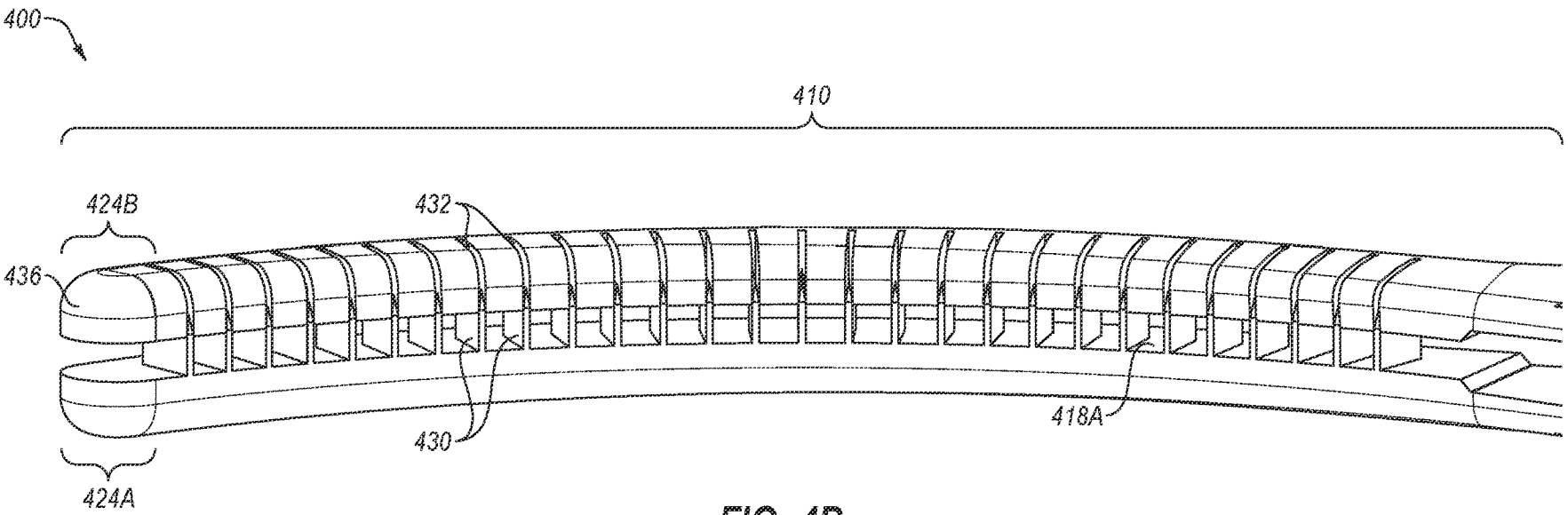
FIG. 4B is an illustration of an applicator in a partially closed position, in accordance with some embodiments of the disclosure.
Figure 4C:
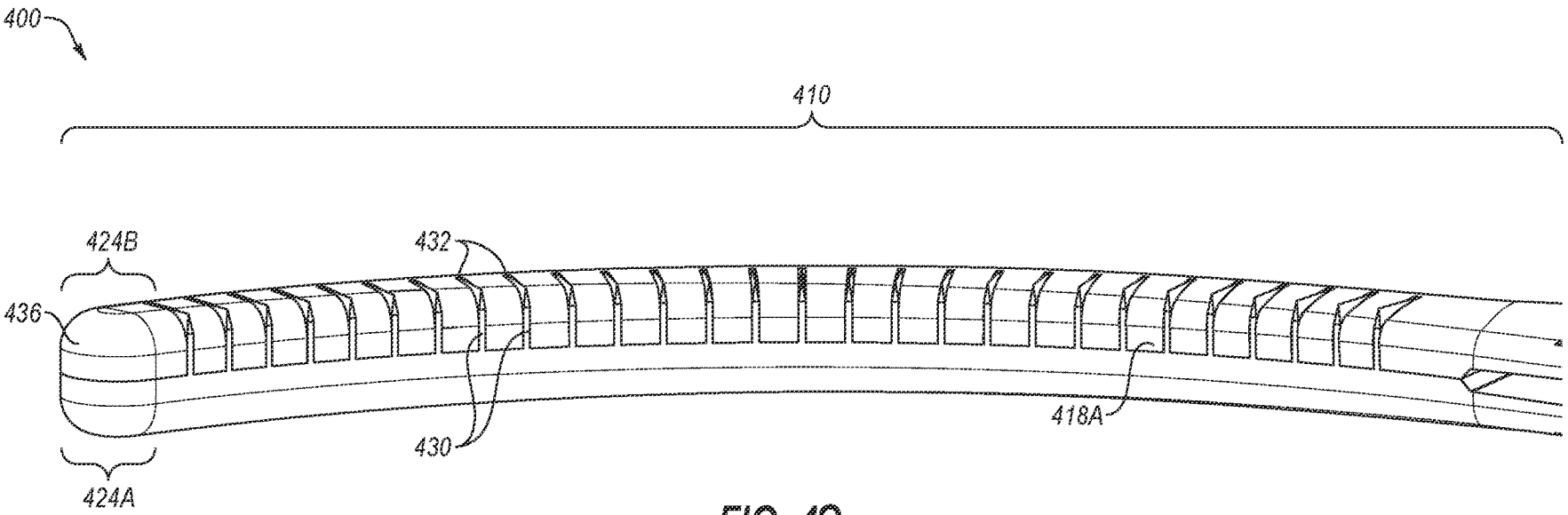
FIG. 4C is an illustration of an applicator in a fully closed position, in accordance with some embodiments of the disclosure.

FIG. 4B is an illustration of an applicator in a partially closed position, in accordance with some embodiments of the disclosure. FIG. 4C is an illustration of an applicator in a fully closed position, in accordance with some embodiments of the disclosure.

In some embodiments, applicator 400 is configured to transition from an open position to a closed position. In some embodiments, the closed position includes two states: a partially closed position as illustrated in FIG. 4B and a fully closed position as illustrated in FIG. 4C. In some embodiments, in the partially closed position one or more of the separating elements 430 of section 410 of arm 402A are configured to insert within at least the corresponding part of the one or more respective slots 432. In some embodiments, in the partially closed position not all (e.g., none of) the interior surface 418 between the separating elements 430 of section 410 contacts the opposing interior surface 418 between the slots 432. In situations where an object, such as an artificial lash extension, is placed between the interior surfaces 118 of the opposing sections 410 of arms 402, the fully closed position can refer to the position of the applicator 400 where the opposing interior surfaces 118 of sections 110 apply pressure to the object (e.g., and the artificial lash extension has been separated into individual clusters).

In some embodiments, in the fully closed position the interior surface 418 between the separating elements 430 of section 410 of arm 402A is configured to contact the opposing interior surface 118 between the slots 132 of section 410 of arm 402B. In some embodiments, applicator 400 is configured to transition from an open position to a partially closed position and from the partially closed position to a fully closed position in a single continuous motion of the opposing arms 402 coming together.

Figure 4D:
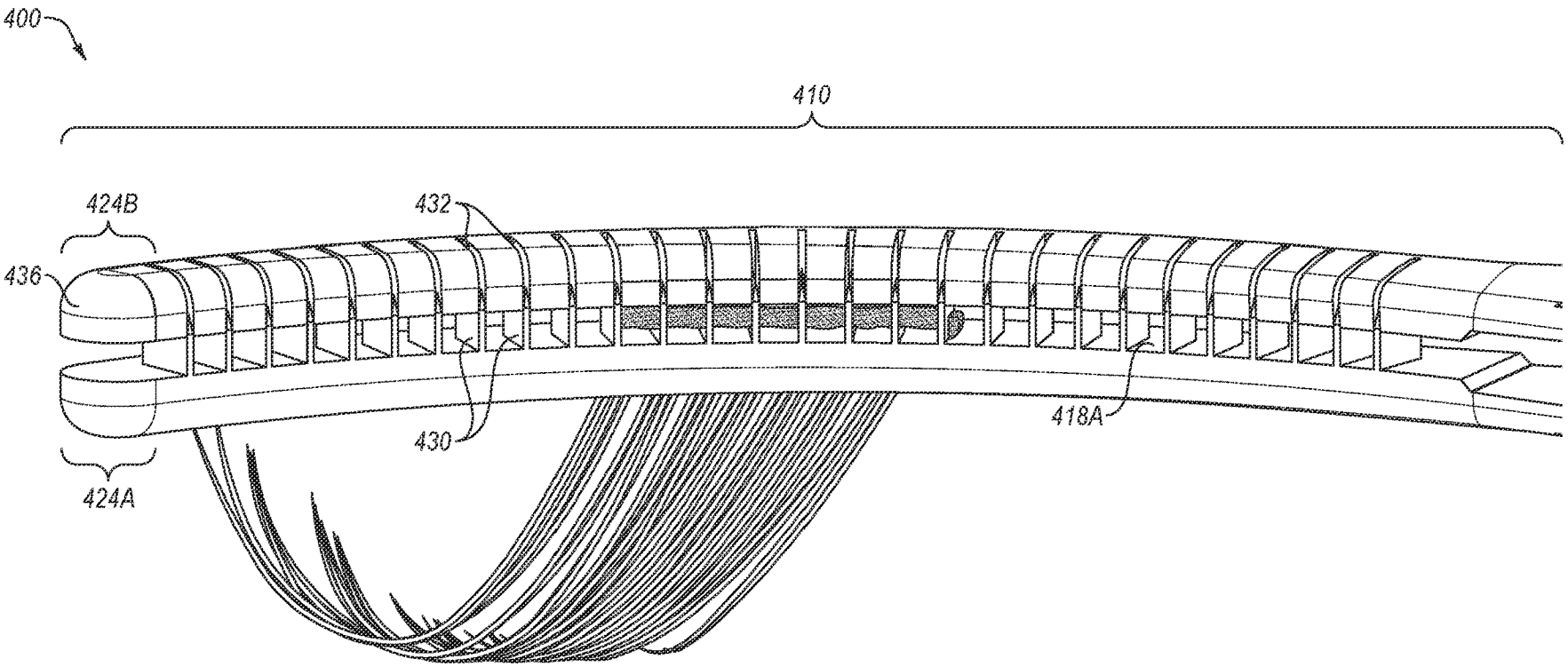
FIG. 4D is an illustration of an applicator in a partially closed position that detaches the artificial hairs of an artificial lash extensions, in accordance with some embodiments of the disclosure.
Figure 4E:
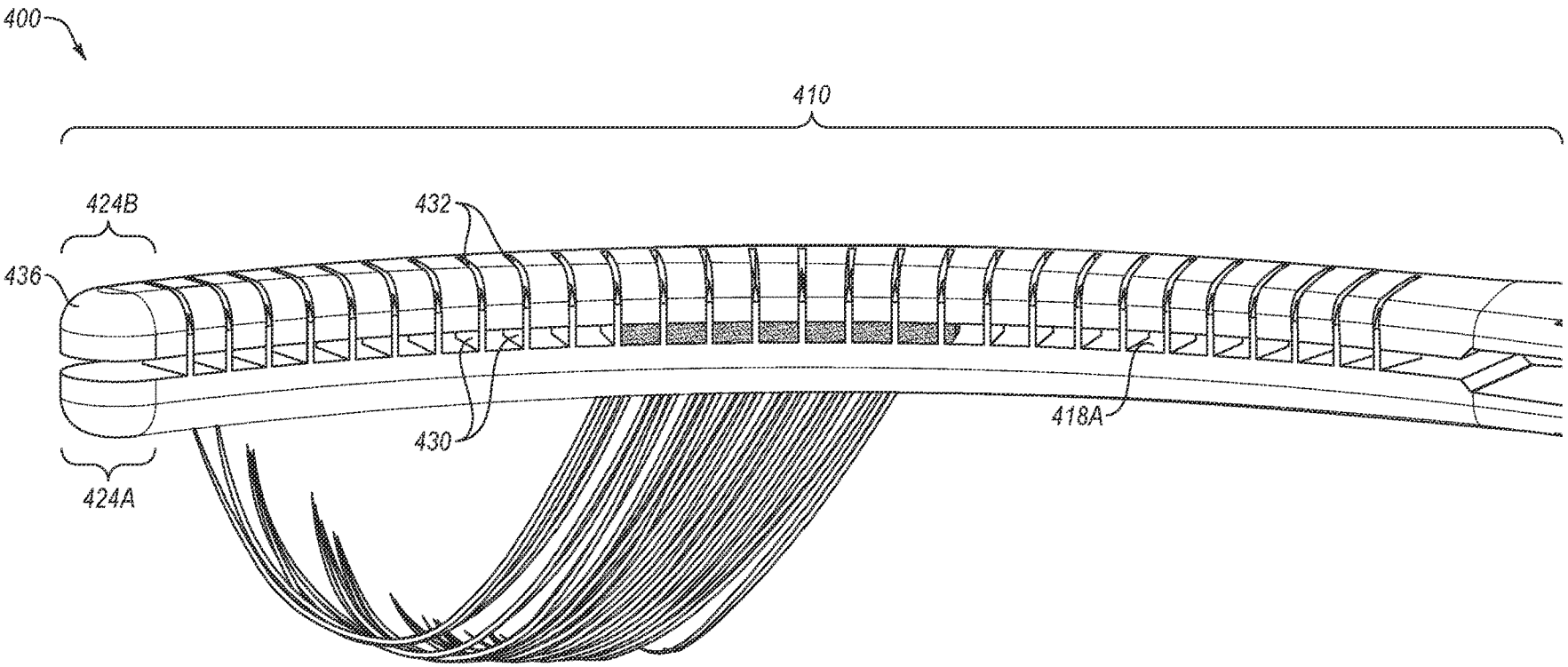
FIG. 4E is an illustration of an applicator in a fully closed position that applies pressure to the detached artificial hairs, in accordance with some embodiments of the disclosure.

FIG. 4D is an illustration of an applicator in a partially closed position that detaches the artificial hair of an artificial lash extension, in accordance with some embodiments of the disclosure. FIG. 4E is an illustration of an applicator in a fully closed position that applies pressure to the detached artificial hairs, in accordance with some embodiments of the disclosure. Applicator 400 of FIG. 4D shows the applicator 400 in the partially closed position detaching the artificial hairs from the artificial lash extension. The separating elements 430 of applicator 400 can split the artificial lash extension into multiple sections of artificial hairs, as illustrated. Applicator 400 of FIG. 4E shows the applicator 400 in the fully closed position and applying pressure to the detached artificial hairs of the artificial lash extension.

Figure 4F:
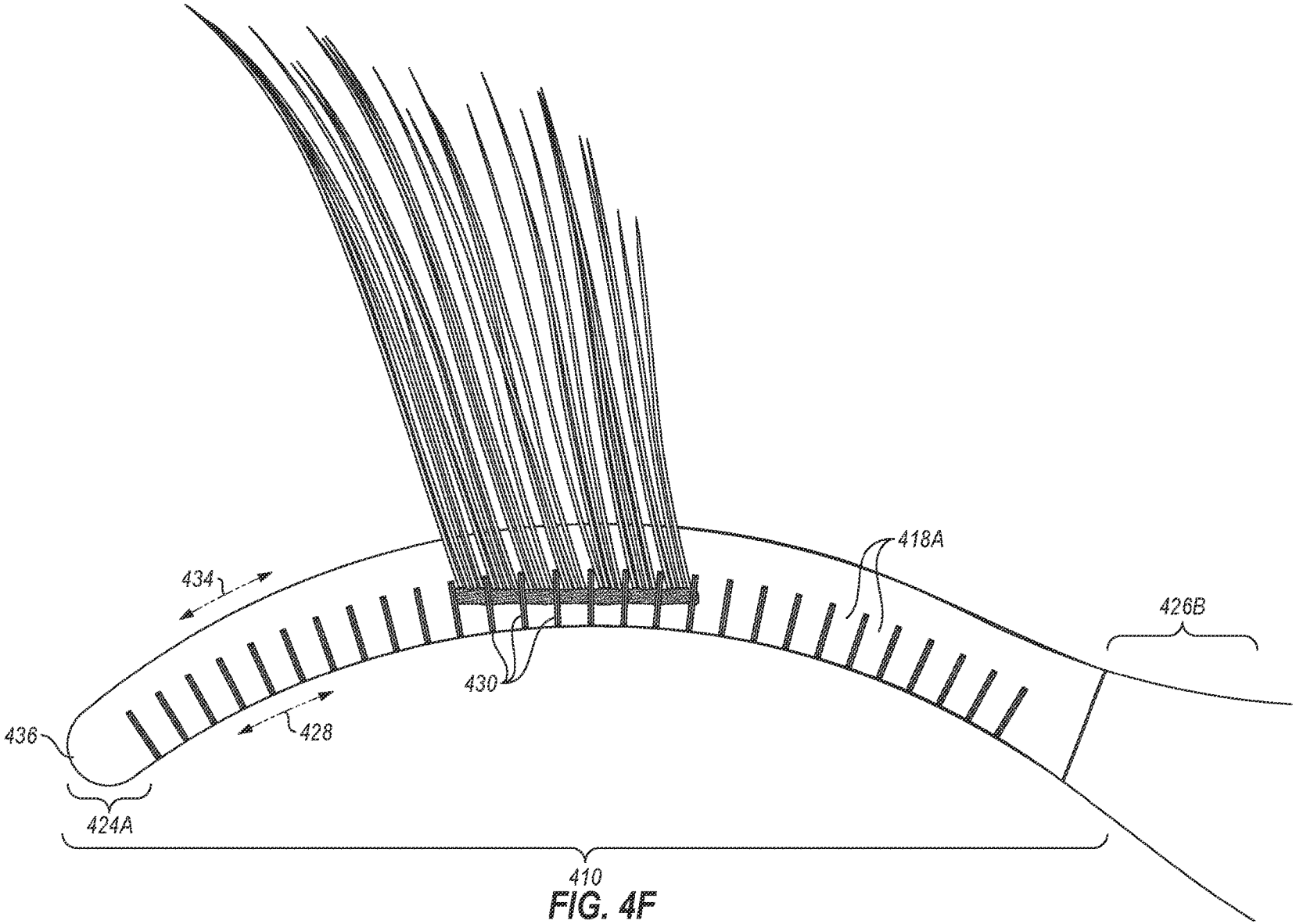
FIG. 4F is an illustration of the detached artificial hairs in an arm of the applicator, in accordance with some embodiments of the disclosure.

FIG. 4F is an illustration of the detached artificial hairs in an arm of the applicator, in accordance with some embodiments of the disclosure. Applicator 400 of FIG. 4F shows the detached artificial hairs, in this case clusters, of the artificial lash extension between the separating elements 430 of section 410 of applicator 400.

FIGS. 5A-5E are illustrations showing operations for securing detached artificial hairs from artificial lash extensions at the underside of natural lashes, in accordance with embodiments of the disclosure.

Figure 5A:
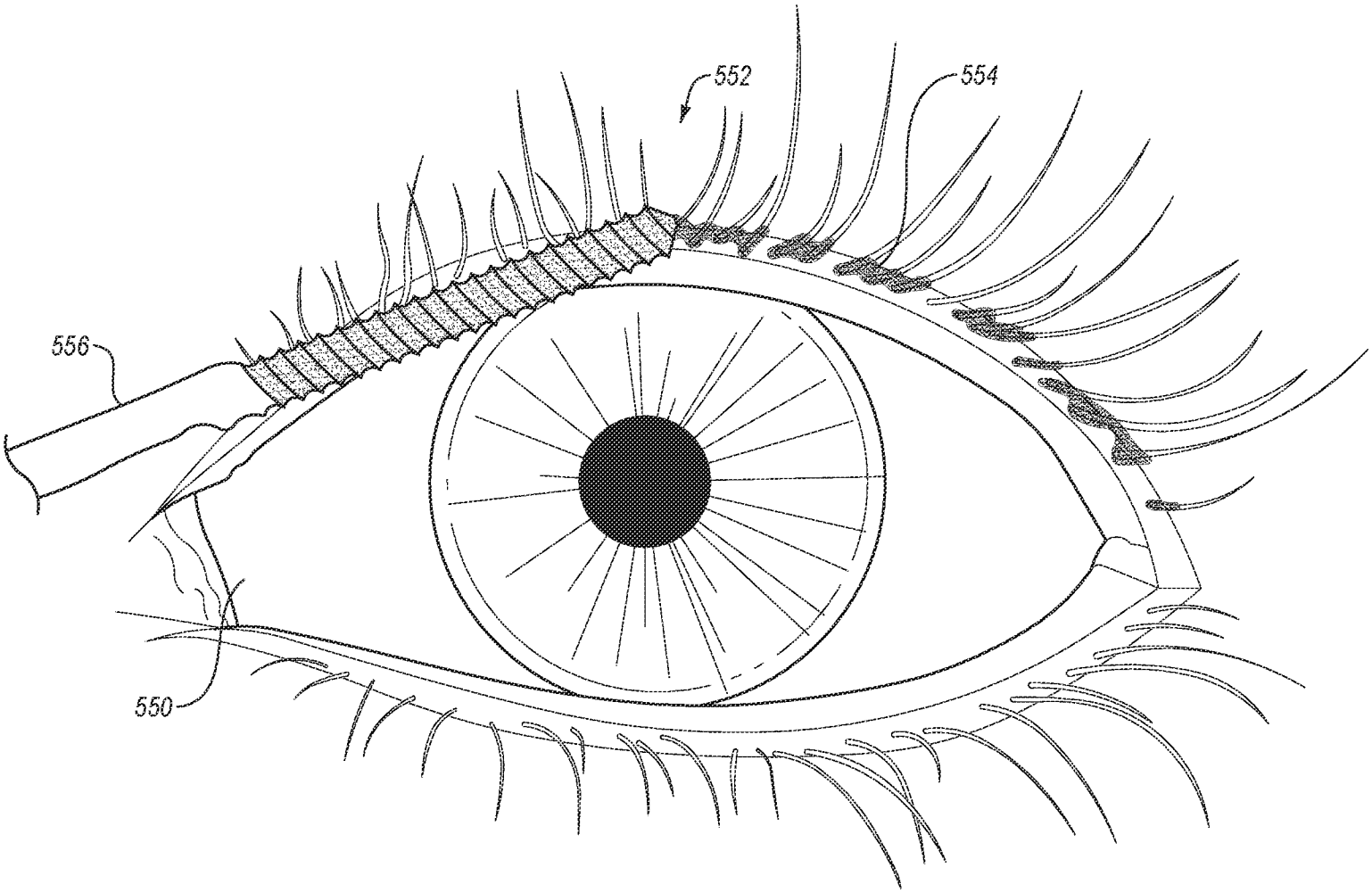
FIGS. 5A-5E are illustrations showing operations for securing detached artificial hairs from artificial lash extensions at the underside of natural lashes, in accordance with embodiments of the disclosure.

FIG. 5A shows the adhesive 554 applied using adhesive application tool 556 (e.g., a brush) to the underside of the upper natural lashes 552 of an eye 550. The adhesive may include one or more of a glue, a mascara, a bonding agent, an epoxy, a paste, or any other natural or synthetic substance having an adhesive quality.

Figure 5B:
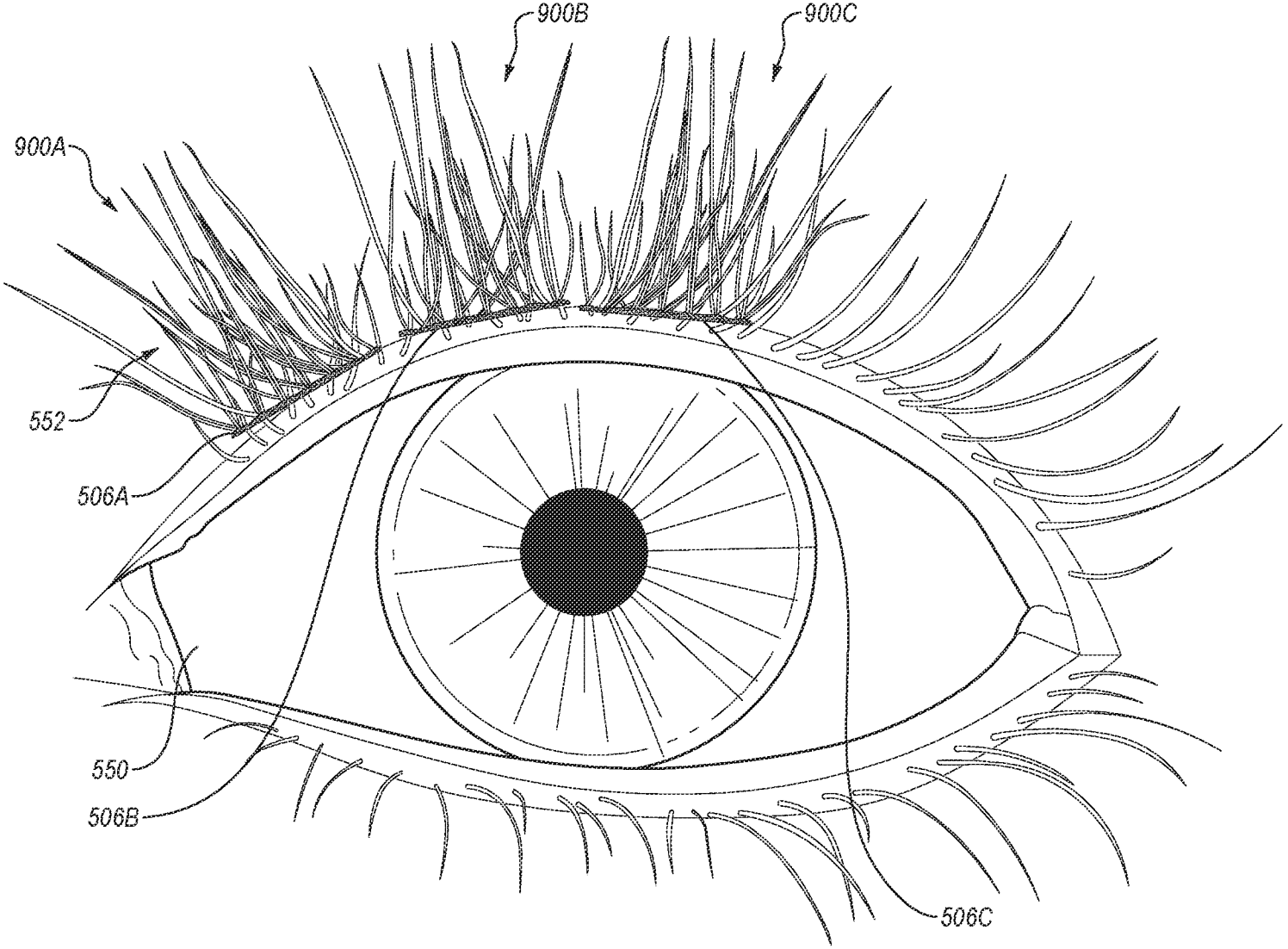

FIG. 5B shows a first set of artificial lash extensions 500A-C (generally referred to as "artificial lash extensions 500" herein) arranged at the underside of the natural lashes of the user's eye. In some embodiments, each of artificial lash extensions 500A-C including bases 506A-C, respectively. The bases 506A-C can be arranged at the underside of the natural eyelashes 552. In some embodiments, bases 506A-C are arranged proximate to the lash line of the eye 550. In some embodiments, at least a part of the top side of bases 506A-C are attached (via the adhesive) to the underside of the natural lashes 552. In some embodiments, at least part of some the artificial hairs of the artificial lash extensions 500 are attached (via the adhesive) to the underside of the natural lashes 552. It should be understood that the size and number of artificial lash extensions is shown for purposes of illustration, rather than limitation. In some embodiments, any number of artificial lash extensions can be attached to the natural eyelash. Although the artificial lash extensions are shown as segments of a given size, in other embodiments the artificial lash extension can be larger segments (or smaller segments) that extend, for example, across approximately half of the lash line (e.g., two artificial lash extensions can cover the upper lash). In still other embodiments, a single artificial lash extension can substantially cover the lash line.

Figure 5C:
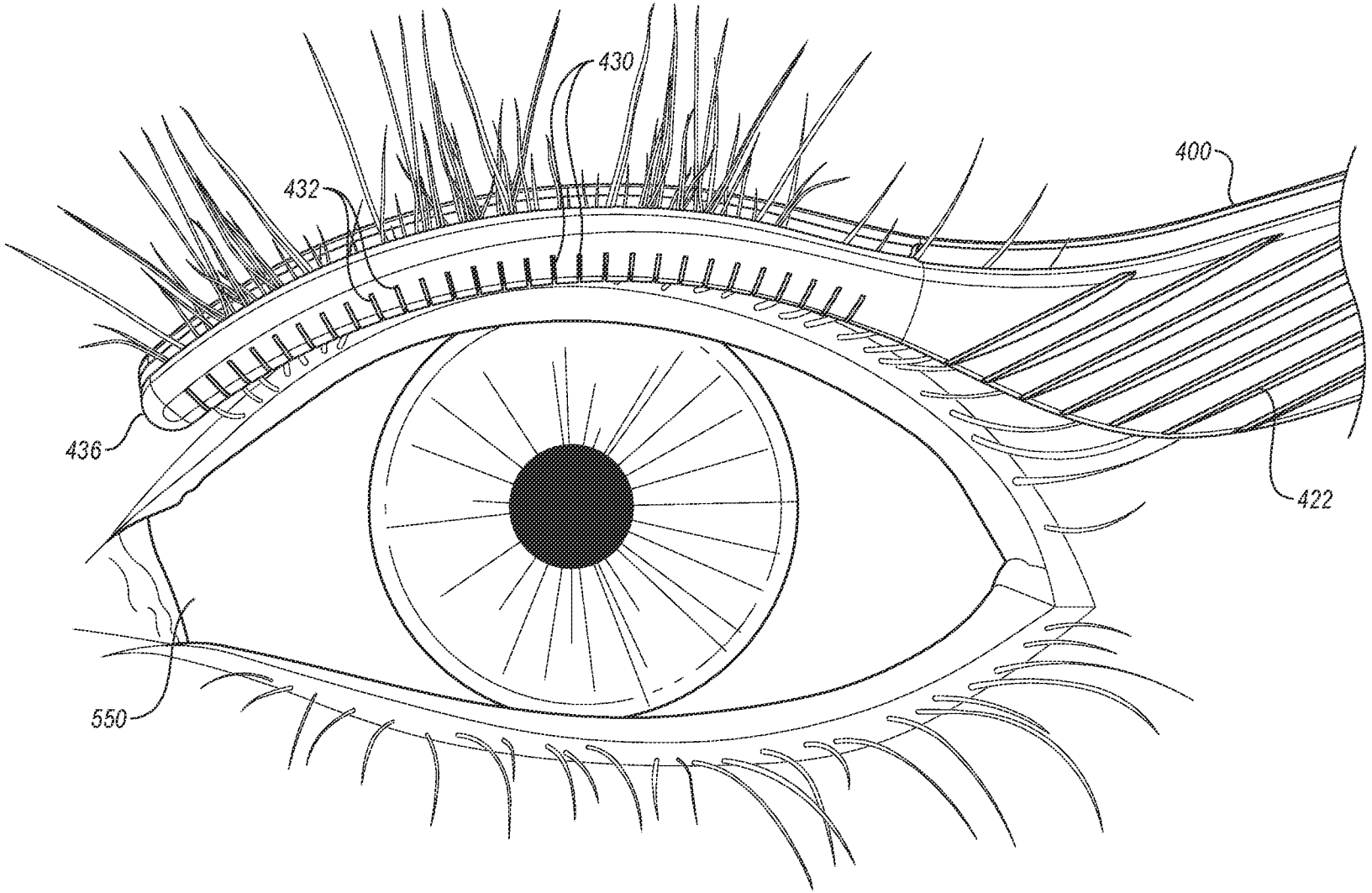

FIG. 5C shows artificial hairs being detached from each of the artificial lash extensions 500A-C affixed to the underside of the natural lash using applicator 400. The separating elements of the applicator 400 can be used to cut or detach the artificial hairs (e.g., clusters) from the artificial lash extensions based on an application of pressure to the exterior surface of the applicator 400 by the user. It should be understood that the applicator 400 is shown in size relative to the eye 550 for purposes of illustration rather than limitation. In some embodiments, the section 410 of applicator 400 can be configured so that separating elements extend to cover the entire lash line of the eye 550.

Figure 5D:
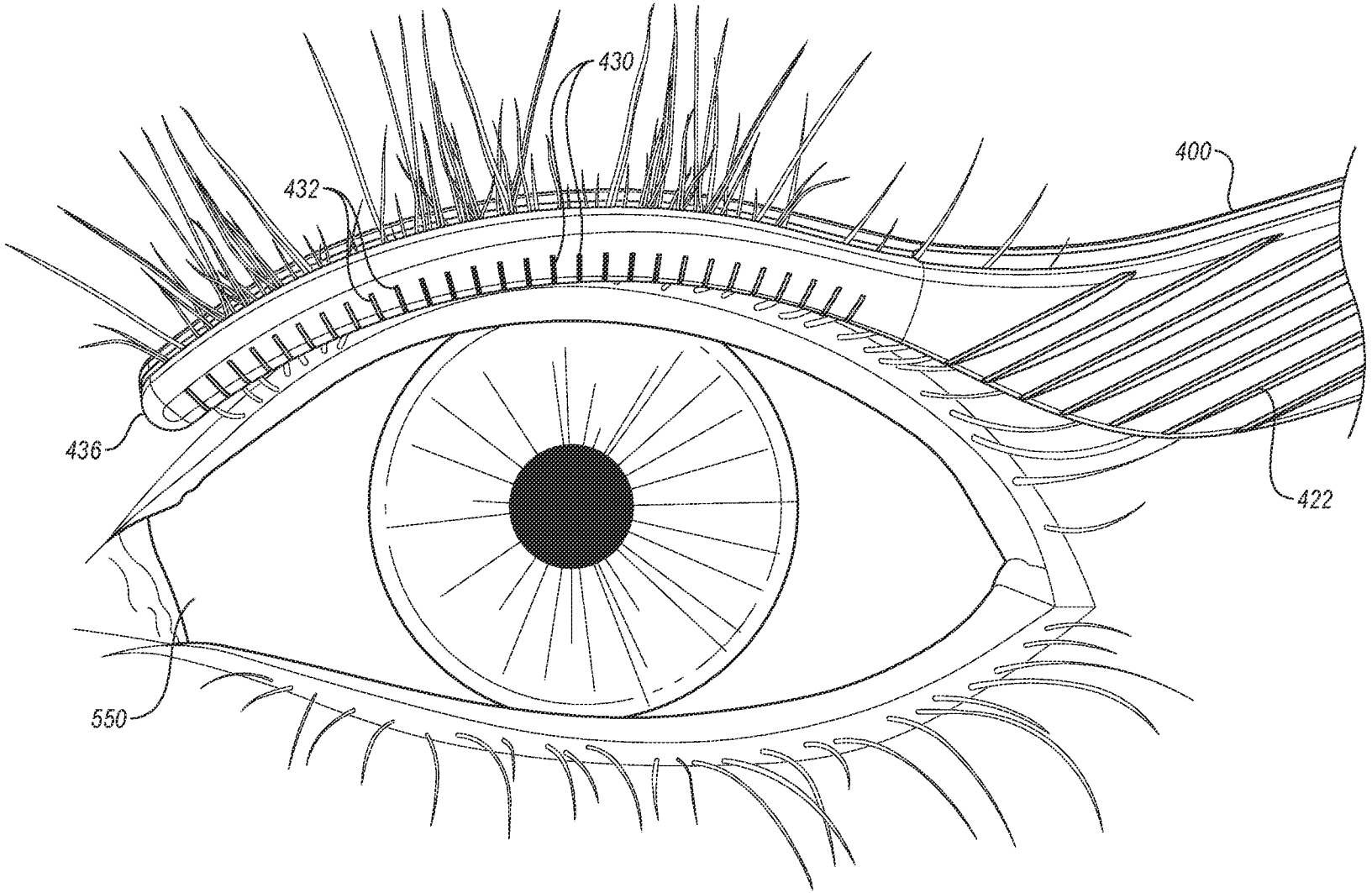

FIG. 5D shows the detached artificial hairs being affixed (e.g., bonded) to the underside of the natural lashes of the user. In some embodiments, the interior surfaces between the separating elements and the interior surfaces between the slots can apply pressure to the detached artificial hairs and natural lashes and cause the detached artificial hairs to have a more secure bond with the natural lashes (more secure than if the additional pressure were not applied). The application of pressure can cause the bonded surface between the detached artificial hairs and the natural lashes to increase (more than if the application of pressure where not applied). In some embodiments, a single motion of the arms of the applicator coming together can detach the artificial hairs from the artificial lash extensions and affix (e.g., secure) the detached artificial hairs to the underside of the natural lashes.

Figure 5E:
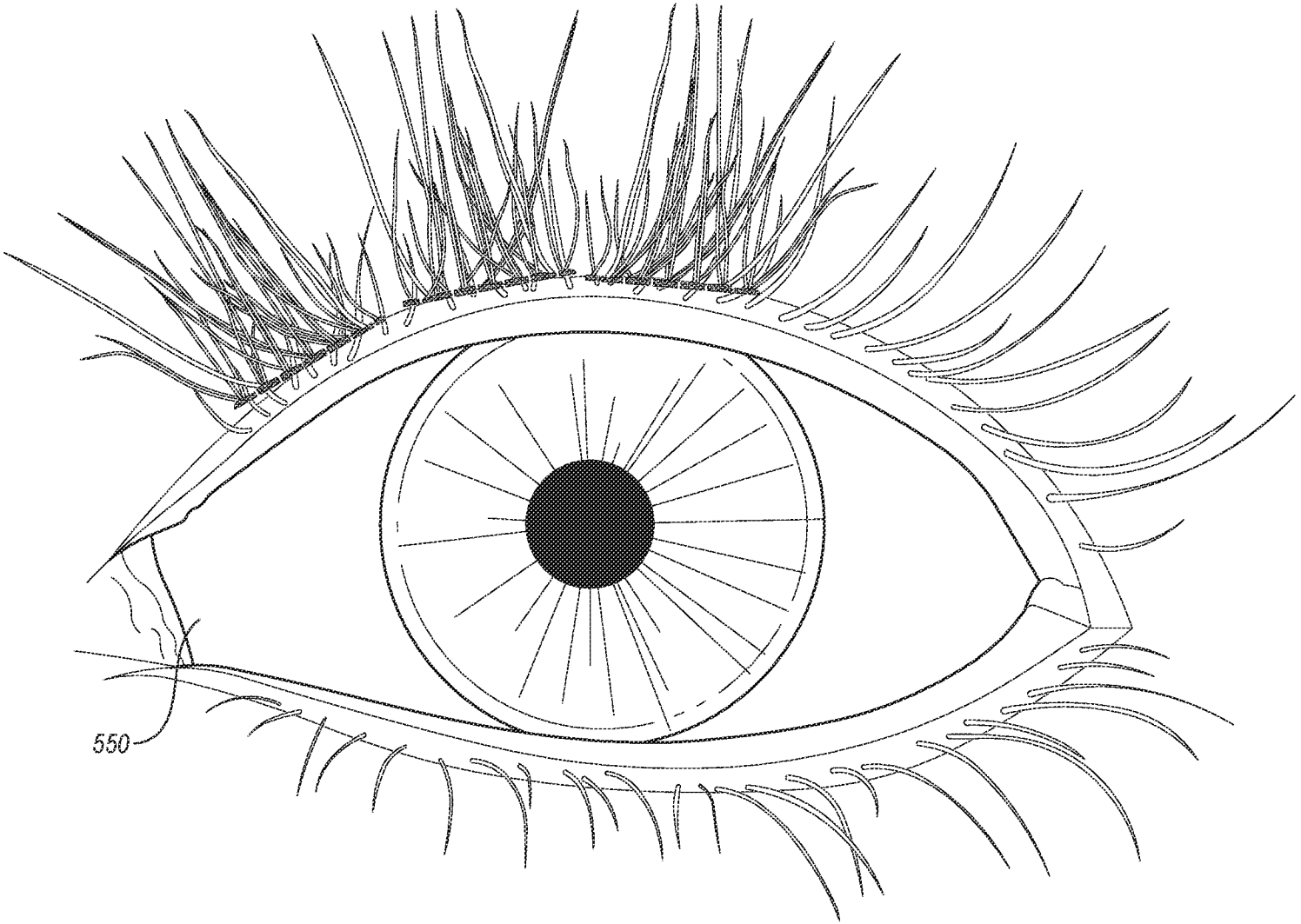

FIG. 5E shows the detached artificial hairs affixed to the underside of the natural lashes of the user. As illustrated, the detached artificial hairs have been detached from the respective artificial lash extensions and are secured to the underside of the natural lashes of the user.

Method 600 and 700 are described as a series of operations (or acts). It should be understood that some operations can be performed concurrently with other operations. In some embodiments, the same, fewer or greater number of operations can be performed in the same or different order. In some embodiments, different operations can be performed or the multiple operations can be combined into a single operation, or a single operation can be performed using multiple operations.

Figure 6:
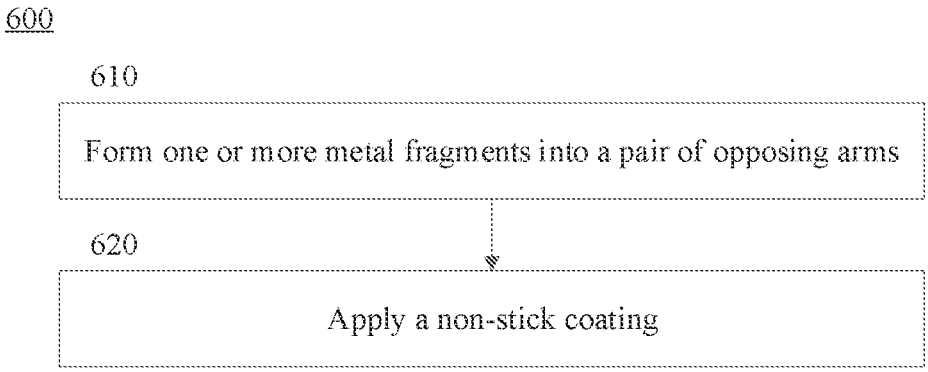
FIG. 6 is a flow diagram illustrating operations for manufacturing an applicator, in accordance with embodiments of the disclosure.

FIG. 6 is a flow diagram illustrating operations for manufacturing an applicator, in accordance with embodiments of the disclosure. Method 600 of FIG. 6 can be performed by one or more pieces of manufacturing equipment or tools, collectively referred to as manufacturing equipment herein.

At operation 610 of method 600, manufacturing equipment forms one or more metal fragments into a pair of opposing arms. In some embodiments, the pair of opposing arms includes a first arm and a second arm that are joined at proximal ends. In some embodiments, each of the first arm and the second arm include a first section having the proximal end, a second section positioned between and connected to the first section of a third section, and the third section. In some embodiments, the third section extends distally from the second section. In some embodiments, the third section includes a first end portion and a second end portion. In some embodiments, the third section includes a first curvature disposed between the first end portion and the second end portion.

In some embodiments, the third section of the first arm includes separating elements that extend from an interior surface of the third section. In some embodiments, the separating elements of the third section of the first arm are design to detach artificial hairs from a lash extension of artificial hairs. In some embodiments, the separating elements of the third section of the first arm are designed to detach the artificial hairs from the lash extension that is attached to an underside of natural lashes of a user. In some embodiments, the detached artificial hairs can remain attached to the underside of the natural lashes of the user. In some embodiments, the artificial lash extension includes clusters of artificial hairs. The separating elements of the third section of the first arm are designed to detach one or more clusters of artificial hairs from the artificial lash extension. In some embodiments, the interior surface of the third section of the first arm between the separating elements is designed to press the detached artificial hairs to the natural lashes. In some embodiments, the separating elements extend substantially perpendicular to the interior surface of the third section.

In some embodiments, the third section of the second arm includes slots. In some embodiments, one or more of the slots of the third section of the second arm are configured to receive a respective one of the separating elements of the third section of the first arm.

In some embodiments the one or more metal fragments include a pair of metal fragments. In some embodiments, forming the pair of metal fragments further includes molding at least part of the first arm and the second arm of the pair of opposing arms from a respective metal fragment in the pair of metal fragments, and joining the pair of opposing arms at the proximal end of each opposing arm.

In some embodiments, one or more of the metal fragments include at least one of stainless steel, hardened steel, or titanium. In some embodiments, the first section, the second section, and the third section of the respective opposing arm are formed of a same material At operation 620, manufacturing equipment applies a non-stick coating to the third sections of the arms. In some embodiments, the non-stick coating includes at least one of polytetrafluoroethylene coating or a silicone coating In some embodiments, the applicator is configured to transition from an open position to a closed position responsive to an application of pressure to the pair of opposing arms. In some embodiments, in the open position the separating elements and the slots are configured to be separated from one another. In some embodiments, the open position of the applicator is a default position.

In some embodiments, the closed position includes a first closed position and a second closed position. In some embodiments, in the first closed position at least part of each of the separating elements are configured to insert within at least a corresponding part of each of the slots. In some embodiments, in the second closed position the interior surface between the separating elements of the third section of the first arm is configured to contact the interior surface between the slots of the third section of the second arm.

In some embodiments, at least a part of the third section is joined with the second section. In some embodiments, the joined part is closer to the second end portion than the first end portion of the third section.

In some embodiments, the first section, the second section, and the third section longitudinally extend toward the proximal end.

In some embodiments, each of the first arm and the second arm include a first side opposite a second side, and an interior surface opposite an exterior surface. The interior surface and the exterior surface extend between the first side and the second side.

In some embodiments, the third section includes a second curvature disposed between the first end portion and the second end portion and along at least a part of the first side corresponding to the third section. The second curvature is positioned opposite the first curvature.

In some embodiments, the first curvature is disposed along at least a part of the second side corresponding to the third section. In some embodiments, the first curvature is a concave curvature and the second curvature is a convex curvature. In some embodiments, an apex of the concave curvature is oriented distally from the second end portion and oriented proximally from the first end portion such that the concave curvature is facing opposite the first side corresponding to the third section. In some embodiments, the first curvature of the third section is designed to align substantially flush with a shape of a lash line In some embodiments, the first end portion of the third section includes a distal end of the respective opposing arm. In some embodiments, the distal end of the respective opposing arm is a single terminal distal end of the respective opposing arm.

In some embodiments, the second section includes a third curvature disposed along at least a part of the second side corresponding to the second section. In some embodiment, the third curvature is designed to rest above and/or on a cheek bone or a nose bridge.

Figure 7:
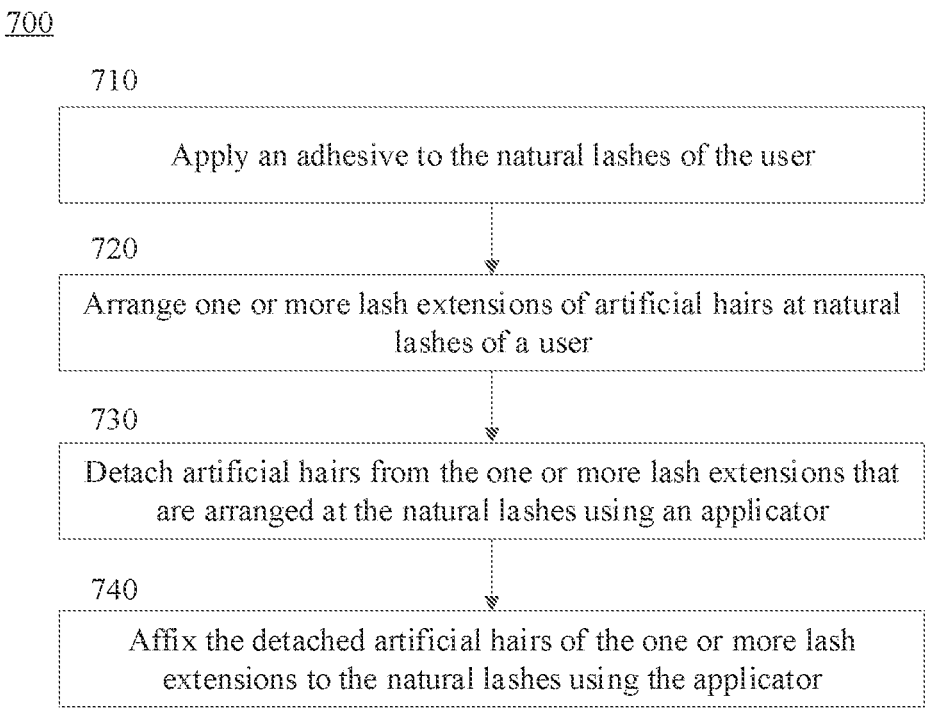
FIG. 7 a flow diagram illustrating operations for securing detached artificial hairs from artificial lash extensions at the underside of natural lashes, in accordance with embodiments of the disclosure.

FIG. 7 a flow diagram illustrating operations for securing detached artificial hairs from artificial lash extensions at the underside of natural lashes, in accordance with embodiments of the disclosure. Method 700 of FIG. 7 can be performed by a user applying artificial lash extensions. In some embodiments, the user can use an applicator, as described herein, to perform at least some of the operations of method 700. The user of method 700 can be the same user on whom the artificial lash extensions are applied or another user that applies the artificial lash extension on behalf of the user.

At operation 710 of method 700, an adhesive may be applied at natural lashes of a user. In some embodiments, the adhesive can be applied to the underside of the natural lashes, such as the underside of the upper natural lashes. In some embodiments, rather than the underside, the adhesive may be applied to the top or sides of the upper natural lashes.

In some embodiments, the adhesive may be one or more of a glue, a mascara, a bonding agent, an epoxy, a paste, or any other natural or synthetic substance having an adhesive quality. In some embodiments, the adhesive may be a waterproof formulation that allows artificial lash extensions (and/or detached artificial hairs thereof) to remain affixed to the individual's natural lashes for periods of time (e.g., hours, days, weeks, or months). In some embodiments, the adhesive may be a commercially-available adhesive for conventional lash extensions or a specialized composition for use with the lash extensions described herein. The adhesive may be clear or colored (e.g., milky white or black to emulate mascara).

In some embodiments, the adhesive may be applied using a brush, a comb, or any other type of application tool. In some embodiments, the adhesive may be applied one to two millimeters away from the waterline. In other embodiments, the adhesive may be applied at any location along the natural lashes or along the waterline. In some embodiments, it may be desirable to wait a predetermined period of time prior to proceeding to operation 720 to allow for the adhesive to activate (e.g., partially cure) its adhesive quality.

At operation 720, the user arranges one or more lash extensions at the natural lashes of the user. In some embodiments, the one or more artificial lash extensions (e.g., lash extensions) may be arranged at the underside of the natural lashes. In some embodiments, the top side of each base of each of the artificial lash extensions can be arranged directly to the underside of the natural lashes (rather than to the eyelid). In some embodiments, the one or more artificial lash extensions may be arranged to align with the curvature of the lash line. For example, multiple artificial lash extensions may be arranged adjacent to one another (e.g., not overlapping or overlapping) such that the bases align with the curvature of the lash line. Thus, the one or more artificial lash extensions may become substantially flush with the lash line when the artificial lash extensions are arranged proximate to the lash line.

In some embodiments, one or more artificial lash extensions can be arranged at the underside of the natural lash at a time. For example, a single artificial lash extension can be arranged first, another artificial lash extension can be arranged subsequently, and so forth. In some embodiments, an applicator can be used to arrange the one or more artificial lash extensions. The user can further re-arrange one or more of the artificial lash extensions as desired.

In some embodiments, arranging the one or more lash extensions of artificial hairs at the natural lashes of the user includes arranging the one or more lash extensions adjacent to one another at the natural lashes.

In some embodiments, the artificial lash extensions arranged at the natural lashes can include one to eight distinct artificial lash extensions. The number of artificial lash extensions arranged at the natural lashes may be based on the width of the artificial lash extension, the thickness of the artificial hair used, the desired style, the desired lash density (also referred to as "fullness" of the user's lashes), etc.

In some embodiments, rather than applying adhesive to the natural lashes (as discussed at operation 710) and then arranging the one or more artificial lash extensions to the natural lash (as discussed at operation 720), the adhesive may be applied to (e.g., the topside of) one or more artificial lash extensions, and then the artificial lash extensions may be arranged at (e.g., the underside of) the natural lash.

At operation 730, the user can detach artificial hairs from the one or more lash extensions that are arranged at the natural lashes of the user using the applicator.

At operation 740, the user can affix the detached artificial hairs of the one or more lash extensions to the natural lashes using the applicator. In some embodiments, each of the detached artificial hairs (e.g., clusters) may be affixed (e.g., bonded) to the underside of the natural lash. In some embodiments, once the one or more artificial lash extensions are arranged in a desired arrangement, artificial hairs of the artificial lash extensions can be separated from the artificial lash extensions and the detached artificial hairs can be affixed so that the detached artificial hairs are secured to and more permanently attached (e.g. for days) to a surface, such as the underside of the natural lash. In some embodiments, one or more of an application of pressure using the applicator or passage of time to cure the adhesive can be used to help affix the detached artificial hairs. In some embodiments, an applicator may be used to affix (e.g., apply pressure) the detached artificial hairs to the natural lashes.

In some embodiments, the applicator may be used to grasp each artificial lash extension individually and arrange the artificial lash extension at the underside of the natural lashes. In some embodiments, the user may arrange a first artificial lash extension to the underside of the natural lash, detach artificial hairs from the first artificial lash extension, and affix the detached artificial hairs using the applicator, then apply a second artificial lash extension to a location adjacent to the affixed artificial hairs, detach artificial hairs from the second artificial lash extension and affix the detached artificial hairs using the applicator, and continue this process until each artificial lash extension is arranged, the respective artificial hairs are detached and the detached artificial hairs are affixed. In some embodiments, the user may wait to detach the artificial hairs of the first artificial lash extensions until multiple artificial lash extensions are arranged. In some embodiments, two or more of the operations of arranging, detaching and affixing can be combined into a single operation.

In some embodiments, the applicator includes a first arm and a second arm of a pair of opposing arms. In some embodiments, a section of the first arm includes separating elements disposed at an interior surface of the section. In some embodiments, the separating elements are design to detach the artificial hairs from the one or more lash extension of artificial hairs.

In some embodiments, the corresponding section of the second arm of the applicator includes slots each configured to receive a respective one of the separating elements of the section of the first arm.

In some embodiments, applying pressure to the pair of opposing arms can transition the applicator from an open position to a closed position. The application of pressure to the pair of opposing arms causes the detaching of the artificial hairs from the one or more lash extensions and the affixing of the detached artificial hairs of the one or more lash extensions to the natural lashes.

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling those skilled in the relevant art to understand the claimed subject matter, the various embodiments, and the various modifications that are suited to the particular uses contemplated.

Reference throughout this specification to "one embodiment," "certain embodiments," "one or more embodiments," "some embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment," "some embodiments" or "in an embodiment" in various places throughout this specification are not necessarily referring to the same embodiment of the invention. Furthermore, the particular features, structures, materials, or characteristics may be combined in any suitable manner in one or more embodiments.

The terms "connected," "coupled," or any variant thereof includes any connection or coupling between two or more elements, either direct or indirect.

As used herein, the singular forms "a," "an," and "the" include plural references unless the context clearly indicates otherwise. Thus, for example, reference to "an element" includes a single element as well as two or more different elements. The words "example" or "exemplary" are used herein to mean serving as an example, instance, or illustration. Any aspect or design described herein as "example' or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or." That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances.

What is claimed is:

1. An apparatus comprising:

a pair of opposing arms comprising a first arm and a second arm, wherein the first arm and the second arm are joined at proximal ends, each of the first arm and the second arm comprising:

a first section comprising the proximal end;

a second section positioned between and connected to the first section and a third section; and the third section comprising a first end portion and a second end portion, the third section having a first curvature disposed between the first end portion and the second end portion, wherein the third section of the first arm comprises a plurality of separating elements that extend from an interior surface of the third section of the first arm, wherein the third section of the second arm comprises a plurality of slots that extend from an interior surface of the third section of the second arm into a body of the third section, the plurality of slots configured to receive the plurality of separating elements therewithin, and wherein the plurality of separating elements are positioned in a radial arrangement with respect to the first curvature and are shaped to detach artificial hairs from a lash extension of artificial hairs.

2. The apparatus of claim 1, wherein the plurality of separating elements of the third section of the first arm are designed to detach the artificial hairs from the lash extension that is attached to an underside of natural eyelashes of a user, the detached artificial hairs to remain attached to the underside of the natural eyelashes of the user.

3. The apparatus of claim 2, wherein the lash extension comprises a plurality of clusters of artificial hairs, and wherein the plurality of separating elements of the third section of the first arm are designed to detach clusters of artificial hairs from the lash extension.

4. The apparatus of claim 2, wherein the interior surface of the third section of the first arm between the plurality of separating elements is designed to press the detached artificial hairs to the natural eyelashes.

5. The apparatus of claim 1, wherein the plurality of separating elements extend substantially perpendicular to the interior surface of the third section.

6. The apparatus of claim 1, wherein the apparatus is configured to transition from an open position to a closed position responsive to an application of pressure to the pair of opposing arms, in the open position the plurality of separating elements and the plurality of slots are configured to be separated from one another, wherein the open position of the apparatus is a default position.

7. The apparatus of claim 6, wherein the closed position comprises a first closed position and a second closed position, in the first closed position at least part of each of the plurality of separating elements are configured to insert within at least a corresponding part of each of the plurality of slots, and in the second closed position the interior surface between the plurality of separating elements of the third section of the first arm is configured to contact the interior surface between the plurality of slots of the third section of the second arm.

8. The apparatus of claim 1, wherein at least a part of the third section is joined with the second section, and wherein the joined part is closer to the second end portion than the first end portion of the third section.

9. The apparatus of claim 1, wherein the first section, the second section, and the third section longitudinally extend toward the proximal end.

10. The apparatus of claim 1, wherein each of the first arm and the second arm comprise:

a first side opposite a second side, and an interior surface opposite an exterior surface, wherein the interior surface and the exterior surface extend between the first side and the second side.

11. The apparatus of claim 10, wherein the third section comprises a second curvature disposed between the first end portion and the second end portion and along at least a part of the first side corresponding to the third section, and wherein the second curvature is positioned opposite the first curvature, wherein the first curvature is disposed along at least a part of the second side corresponding to the third section, and wherein the first curvature is a concave curvature and the second curvature is a convex curvature.

12. The apparatus of claim 11, wherein an apex of the concave curvature is oriented distally from the second end portion and oriented proximally from the first end portion such that the concave curvature is facing opposite the first side corresponding to the third section, wherein the first end portion of the third section comprises a distal end of the respective opposing arm, and wherein the distal end of the respective opposing arm is a single terminal distal end of the respective opposing arm.

13. The apparatus of claim 10, wherein the second section comprises a third curvature disposed along at least a part of the second side corresponding to the second section, wherein the third curvature is designed to rest above or on a cheek bone or a nose bridge.

14. The apparatus of claim 1, wherein the first curvature of the third section is designed to align substantially flush with a shape of a lash line.

15. The apparatus of claim 1, wherein each of the first arm and the second arm comprises at least one of stainless steel, hardened steel, or titanium, wherein the first section, the second section, and the third section of the respective opposing arm are formed of a same material.

16. A method of manufacturing an apparatus for detaching artificial hairs from an artificial lash extension, comprising:

forming one or more metal fragments into a pair of opposing arms comprising a first arm and a second arm that are joined at proximal ends, each of the first arm and the second arm comprising:

a first section comprising the proximal end;

a second section positioned between and connected to the first section and a third section; and the third section comprising a first end portion and a second end portion, the third section having a first curvature disposed between the first end portion and the second end portion, wherein the third section of the first arm comprises a plurality of separating elements that extend from an interior surface of the third section of the first arm, wherein the third section of the second arm comprises a plurality of slots that extend from an interior surface of the third section of the second arm into a body of the third section, the plurality of slots configured to receive the plurality of separating elements therewithin, and wherein the plurality of separating elements are positioned in a radial arrangement with respect to the first curvature and are shaped to separate the artificial hairs from the artificial lash extension.

17. The method of claim 16, further comprising:

applying a non-stick coating to the third sections of the arms.

18. The method of claim 16, wherein the one or more metal fragments comprises a pair of metal fragments, and wherein forming the pair of metal fragments further comprises:

molding at least part of the first arm and the second arm of the pair of opposing arms from a respective metal fragment in the pair of metal fragments; and joining the pair of opposing arms at the proximal end of each opposing arm.

19. A method comprising:

arranging one or more lash extensions of artificial hairs in an arrangement at natural eyelashes of a user;

detaching, using an applicator, artificial hairs from the one or more lash extensions arranged as the one or more lash extensions are arranged at the natural eyelashes of the user in the arrangement; and affixing the detached artificial hairs of the one or more lash extensions to the natural eyelashes in the arrangement using the applicator.

20. The method of claim 19, wherein the applicator comprises a first arm and a second arm of a pair of opposing arms, the method further comprising:

applying pressure to the pair of opposing arms that transitions the applicator from an open position to a closed position, wherein the application of pressure to the pair of opposing arms causes the detaching of the artificial hairs from the one or more lash extensions and the affixing of the detached artificial hairs of the one or more lash extensions to the natural eyelashes.

* * * * *